US008522567B2

(12) United States Patent
Kim et al.

(10) Patent No.: US 8,522,567 B2
(45) Date of Patent: Sep. 3, 2013

(54) AIR CONDITIONER AND METHOD FOR CONTROLLING THE SAME

(75) Inventors: Won Seok Kim, Changwon-si (KR); Jie Seop Sim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 833 days.

(21) Appl. No.: 12/451,489

(22) PCT Filed: Oct. 22, 2007

(86) PCT No.: PCT/KR2007/005186

§ 371 (c)(1),
(2), (4) Date: Mar. 24, 2010

(87) PCT Pub. No.: WO2008/153250

PCT Pub. Date: Dec. 18, 2008

(65) Prior Publication Data

US 2010/0170282 A1 Jul. 8, 2010

(30) Foreign Application Priority Data

Jun. 14, 2007 (KR) ..... 10-2007-0058515

(51) Int. Cl.
*F25D 21/06* (2006.01)

(52) U.S. Cl.
USPC ..... 62/154; 62/155; 62/156; 62/272

(58) Field of Classification Search
USPC ..... 62/80, 128, 151, 154, 155, 272, 275, 62/156; 340/580
See application file for complete search history.

(56) References Cited

U.S. PATENT DOCUMENTS

| | | | | |
|---|---|---|---|---|
| 5,251,454 | A * | 10/1993 | Yoon | 62/156 |
| 6,701,729 | B2 * | 3/2004 | Bagley | 62/156 |
| 2003/0115899 | A1 * | 6/2003 | Won-Bok | 62/276 |

FOREIGN PATENT DOCUMENTS

| | | | |
|---|---|---|---|
| CN | 1712844 | A | 12/2005 |
| JP | 06-147601 | | 5/1994 |
| JP | 06-317366 | | 11/1994 |
| JP | 07-091782 | | 4/1995 |
| JP | 2007-093071 | A | 4/2007 |
| KR | 10-2002-0090606 | | 12/2002 |
| KR | 10-2002-0092494 | | 12/2002 |

* cited by examiner

*Primary Examiner* — Marc Norman
(74) *Attorney, Agent, or Firm* — McKenna Long & Aldridge LLP

(57) ABSTRACT

An air conditioner is provided. The air conditioner includes a heat exchanger which exchanges heat with air by passing a coolant therethrough; an anti-freeze apparatus which prevents the freeze of water on the surface of the heat exchanger by supplying energy to the heat exchanger; and a heat generation unit which heats the heat exchanger. The air conditioner can minimize the need for a defrost operation and can thus continuously and effectively perform an air conditioning function even when water on the surface of the heat exchanger is frozen.

5 Claims, 16 Drawing Sheets o REFERENCE CURVE(0W)

V FIFTH ENERGY CURVE(0.36W)

IV FOURTH ENERGY CURVE(0.62W)

III THIRD ENERGY CURVE(0.91W)

II SECOND ENERGY CURVE(0.98W)

I FIRST ENERGY CURVE(1.38W)

AIR CONDITIONER AND METHOD FOR CONTROLLING THE SAME

This application is a 35 U.S.C. §371 National Stage entry of International Application No. PCT/KR2007/005186, filed on Oct. 22, 2007, which claims priority to Korean Application No. 10-2007-0058515, filed Jun. 14, 2007, both of which are hereby incorporated by reference in their entireties as if fully set forth herein.

TECHNICAL FIELD

The present invention relates to an air conditioner and a method of controlling the same, and more particularly, to an air conditioner and a method of controlling the same in which the surface of a heat exchanger can be prevented from freezing by supplying energy to the heat exchanger.

BACKGROUND ART

Air conditioners are devices for cooling and cooling indoor rooms using a cooling cycle including a compressor, a condenser, an expansion device, and an evaporator. During the operation of a cooling cycle of an air conditioner, i.e., during the operation of a compressor, water in the air is condensed on the surface of an evaporator, and thus, compressed water is generated. Then, the compressed water drops below the evaporator. However, if the compressed water freezes up on the surface of the evaporator due to low-temperature air around the evaporator, the performance of the air conditioner may deteriorate due to an unsmooth heat exchange between a coolant and air.

In order to address this, the operation of a compressor may be stopped in the middle of the operation of an air conditioner so that the operation of the air conditioner can also be stopped. Then, a defrost operation may be performed for a predetermined amount of time so that the surface of an evaporator can be defrosted. Once the surface of the evaporator is completely defrosted, the operation of the compressor may be resumed so that the operation of the air conditioner can be resumed.

However, since a defrost operation can be performed only after the operation of an air conditioner is stopped, a cooling function or a heating function cannot be performed during a defrost operation, thereby reducing user convenience.

DISCLOSURE

Technical Problem

The present invention provides an air conditioner which can remove ice and/or prevent the freeze of water on the surface of a heat exchanger so that the performance of the air conditioner can be prevented from deteriorating, and that an air conditioning function can be efficiently performed.

The present invention also provides an air conditioner which can remove ice and/or prevent the freeze of water on the surface of a heat exchanger while continuously performing its operation.

The present invention also provides a method of controlling an air conditioner in which an anti-freeze operation and a heating operation are performed at the same time so that water can be effectively prevented from freezing.

Technical Solution

According to an aspect of the present invention, there is provided an air conditioner including a heat exchanger which exchanges heat with air by passing a coolant therethrough; an anti-freeze apparatus which prevents the freeze of water on the surface of the heat exchanger by supplying energy to the heat exchanger; and a heat generation unit which heats the heat exchanger.

The anti-freeze apparatus may include an electrode unit which includes a plurality of electrodes that generate an electric field in the heat exchanger; and a voltage generation unit which applies a voltage to the electrodes.

The heat generation unit may include a hot-wire heater which heats the heat exchanger.

The air conditioner may also include a temperature sensing unit which senses the temperature of at least one of a pipe connected to the heat exchanger, the outside of a room in which the air conditioner is installed, and the heat exchanger; and a control unit which controls the anti-freeze apparatus and the heat generation unit according to the results of the sensing performed by the temperature sensing unit.

The air conditioner may also include an inlet temperature sensor which senses the temperature of a pipe at an inlet of the heat exchanger; an outlet temperature sensor which senses the temperature of a pipe at an outlet of the heat exchanger; and a control unit which compares the result of the sensing performed by the inlet temperature sensor with the result of the sensing performed by the outlet temperature sensor and controls the anti-freeze apparatus and the heat generation unit according to the result of the comparison.

The anti-freeze apparatus may include an electrode unit which includes a plurality of electrodes that generate an electric field in the heat exchanger; and a voltage generation unit which applies a voltage to the electrodes. The air conditioner may also include a current detection unit which detects a current that flows into the electrode unit; and a control unit which controls the heat generation unit and the anti-freeze apparatus according to the result of the detection performed by the current detection unit.

The air conditioner may also include a hardness sensing unit which senses the harness of the heat exchanger; and a control unit which controls the heat generation unit and the anti-freeze apparatus according to the result of the sensing performed by the hardness sensing unit.

The air conditioner may also include a control unit which controls the anti-freeze apparatus and the heat generation unit according to operating conditions of the air conditioner.

The air conditioner may be a heat pump including a compressor, a cooling/heating switching valve, an outdoor heat exchanger, an expansion device, and an indoor heat exchanger, and the anti-freeze apparatus may supply energy to the outdoor heat exchanger during a heating operation of the heat pump.

According to another aspect of the present invention, there is provided a method of controlling an air conditioner, the method including, if water on the surface of a heat exchanger is detected to be frozen during an operation of an air conditioner, heating the heat exchanger; and supplying energy to the heat exchanger so that the water on the surface of the heat exchanger can be prevented from freezing.

The heating the heat exchanger, may include, if the heat exchanger satisfies a set of anti-freeze initiation conditions, performing an anti-freeze operation by supplying energy to the heat exchanger so that water on the surface of the heat exchanger can be prevented from freezing; and if the heat exchanger satisfies a set of anti-freeze release conditions, cutting off the energy supplied to the heat exchanger and heating the heat exchanger.

According to another aspect of the present invention, there is provided a method of controlling an air conditioner, the method including, if a heat exchanger satisfies a set of anti-freeze initiation conditions during an operation of an air conditioner and the temperature of at least one of a pipe connected to the heat exchanger, the outside of a room in which the air conditioner is installed, and the heat exchanger is higher than a reference temperature, performing an anti-freeze operation alone by supplying energy to the heat exchanger so that water on the surface of the heat exchanger can be prevented from freezing; and if the heat exchanger satisfies the anti-freeze initiation conditions during the operation of the air conditioner and the temperature of at least one of the pipe connected to the heat exchanger, the outside of the room, and the heat exchanger is lower than the reference temperature, performing both an anti-freeze operation and a heating operation by heating the heat exchanger while supplying energy to the heat exchanger.

The performing both the anti-freeze operation and the heating operation, may include turning on a hot-wire heater which is disposed near the heat exchanger.

The performing both the anti-freeze operation and the heating operation, may include enabling the air conditioner to perform a defrost operation.

According to another aspect of the present invention, there is provided a method of controlling an air conditioner, the method including, if a heat exchanger satisfies a set of anti-freeze initiation conditions during an operation of an air conditioner and the temperature of at least one of a pipe connected to the heat exchanger, the outside of a room in which the air conditioner is installed, and the heat exchanger is higher than a first reference temperature, performing an anti-freeze operation alone by supplying energy to the heat exchanger so that water on the surface of the heat exchanger can be prevented from freezing; if the heat exchanger satisfies the anti-freeze initiation conditions during the operation of the air conditioner and the temperature of at least one of the pipe connected to the heat exchanger, the outside of the room, and the heat exchanger is lower than the first reference temperature and higher than a second reference temperature, supplying energy to the heat exchanger and either turning on a heater, which is disposed near the heat exchanger, or performing a defrost operation; and if the heat exchanger satisfies the anti-freeze initiation conditions during the operation of the air conditioner and the temperature of at least one of the pipe connected to the heat exchanger, the outside of the room, and the heat exchanger is lower than the second reference temperature, supplying energy to the heat exchanger, turning on the heater, and performing a defrost operation.

Advantageous Effects

The air conditioner according to the present invention prevents the freeze of water on the surface of a heat exchanger during its operation. Thus, there is no need to perform a defrost operation, and it is possible to continuously perform an air conditioning function.

The air conditioner according to the present invention includes an anti-freeze apparatus which has at least one electrode for generating an electric field in the heat exchanger and a voltage generation unit for applying a voltage to the electrode. Thus, the air conditioner according to the present invention has higher durability and higher reliability than a conventional air conditioner including an anti-freeze apparatus having a mechanical vibrator.

The air conditioner according to the present invention includes a heat generation unit which includes a hot-wire heater. Thus, the air conditioner according to the present invention does not need to perform a defrost operation in order to remove ice and can vary the temperature of a heat exchanger to an optimum level for an anti-freeze operation with the aid of the hot-wire heater.

The air conditioner according to the present invention includes a temperature sensing unit which detects the existence, the amount, and/or the freeze of water on the surface of the heat exchanger by detecting the temperature of at least one of the heat exchanger and a pipe that extends to the outside of a room in which the air conditioner is installed. Thus, the air conditioner according to the present invention can efficiently remove ice, if any, on the surface of the heat exchanger or prevent the freeze of water on the surface of the heat exchanger.

The air conditioner according to the present invention includes a current detection unit which detects the existence, the amount, and/or the freeze of water on the surface of the heat exchanger by detecting a current that flows into the electrode. Thus, the air conditioner according to the present invention has high reliability and high precision.

The method of controlling an air conditioner according to the present invention is characterized by quickly performing a defrost operation and preventing the freeze of water with the aid of the anti-freeze apparatus. Thus, it is possible to quickly remove ice and/or prevent the freeze of water.

The method of controlling an air conditioner according to the present invention is also characterized by allowing a heat generation unit to heat a heat exchanger immediately after the termination of the operation of the anti-freeze apparatus and thus preventing melting frost on the surface of the heat exchanger from freezing again. Therefore, it is possible to prevent the performance of an air conditioner from deteriorating when the operation of the air conditioner is resumed when water on the surface of the heat exchanger is frozen. In addition, it is possible to improve the air conditioning performance of an air conditioner.

The method of controlling an air conditioner is also characterized by performing an anti-freeze operation alone if the temperature of water on the surface of the heat exchanger is high and performing both an anti-freeze operation and a heating operation if the temperature of the heat exchanger is low. Therefore, it is possible to appropriately adjust the operation of the air conditioner according to the state of water on the surface of the heat exchanger.

The method of controlling an air conditioner is also characterized by turning on a heater without the need to perform a defrost operation or performing a defrost operation alone if the temperature of water on the surface of the heat exchanger is relatively low and thus melting frost on the surface of the heat exchanger while minimizing the power consumption of the air conditioner. In addition, the method of controlling an air conditioner is also characterized by turning on the heater and performing a defrost operation if the temperature of water on the surface of the heat exchanger is too low. Therefore, it is possible to quickly melt frost on the surface of the heat exchanger.

BEST MODE

Figure 1:
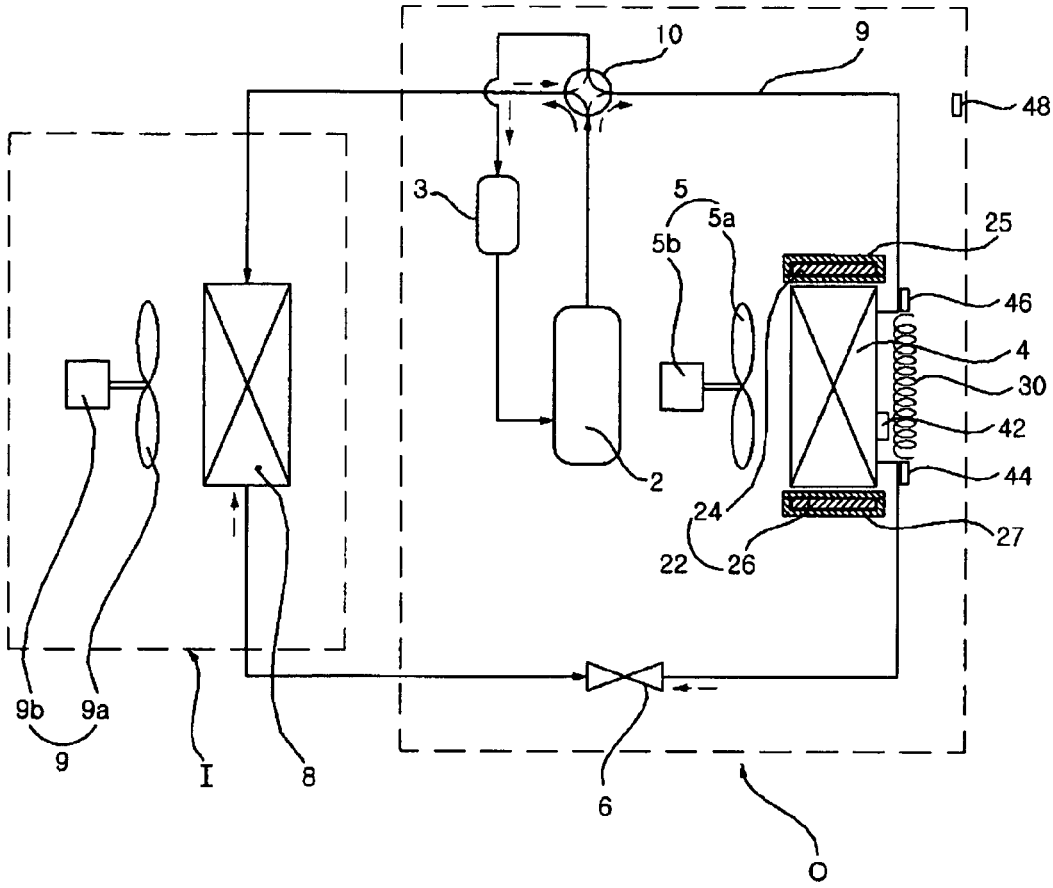
FIG. 1 illustrates a schematic diagram of an air conditioner according to an embodiment of the present invention.
Figure 2:
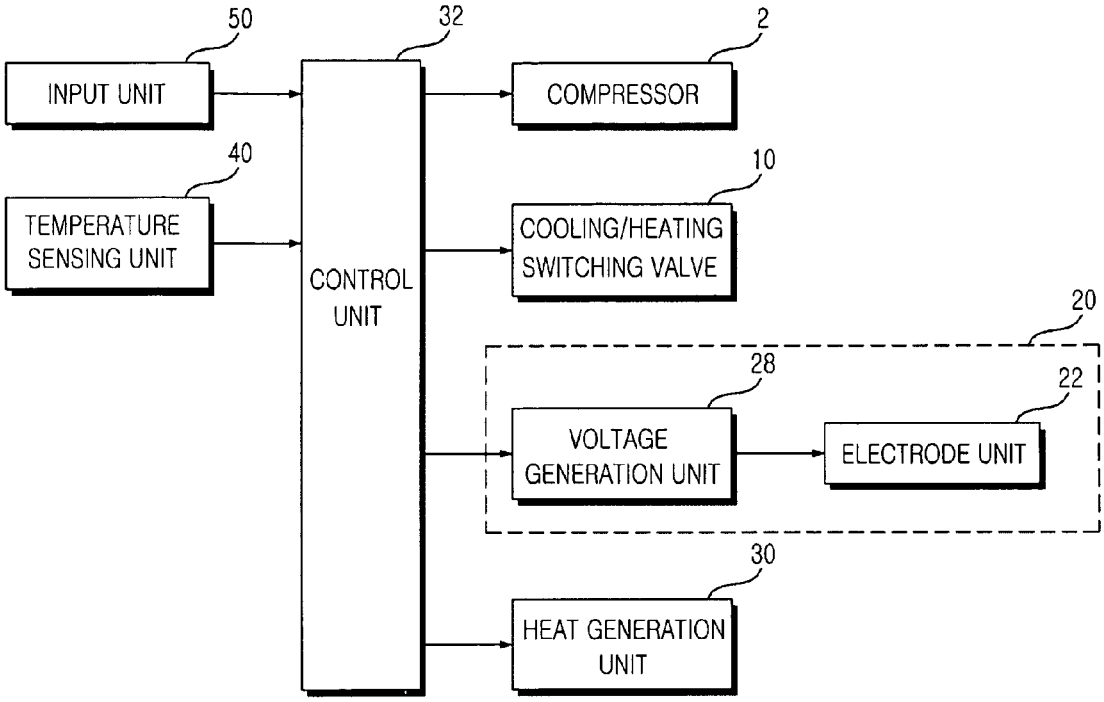
FIG. 2 illustrates a block diagram of the air conditioner illustrated in FIG. 1.

FIG. 1 illustrates a schematic diagram of an air conditioner according to an embodiment of the present invention, and FIG. 2 illustrates a block diagram of the air conditioner illustrated in FIG. 1.

Referring to FIGS. 1 and 2, the air conditioner includes a compressor 2, an outdoor heat exchanger 4, an expansion device 6, an indoor heat exchanger 8, and an anti-freeze apparatus 20 which supplies energy to the compressor 2, the outdoor heat exchanger 4, the expansion device 6 and the indoor heat exchanger 8 and can thus prevent water, if any, on the surfaces of the compressor 2, the outdoor heat exchanger 4, the expansion device 6 and the indoor heat exchanger 8 from freezing.

The air conditioner may be either an air cooler which can cool indoor rooms or a heat pump which not only can cool but also can heat indoor rooms. If the air conditioner is an air cooler, a coolant compressed by the compressor 2 is condensed by passing through the outdoor heat exchanger 5, and the condensed coolant is expanded by passing through the expansion device 6. The expanded coolant is evaporated by the indoor heat exchanger 8. Then, the evaporated coolant is circulated back into the compressor 2. That is, the outdoor heat exchanger 4 may serve as a condenser, and the indoor heat exchanger 8 may serve as an evaporator.

On the other hand, if the air conditioner is a heat pump, rather than an air cooler, the air conditioner may also include a cooling/heating switching valve 10 which shifts the passage of flow of a coolant compressed by the compressor 2 according to whether the air conditioner performs a cooling operation or a heating operation. During a cooling operation, a coolant compressed by the compressor 2 is circulated into the compressor 2 by sequentially passing through the cooling/heating switching valve 10, the outdoor heat exchanger 4, the expansion device 6, the indoor heat exchanger 4, and the cooling/heating switching valve 10. In this case, the outdoor heat exchanger 4 may serve as a condenser, and the indoor heat exchanger 8 may serve as an evaporator.

On the other hand, during a heating operation, a coolant compressed by the compressor 2 is circulated into the compressor 2 by sequentially passing through the cooling/heating switching valve 10, the indoor heat exchanger 8, the expansion device 6, the outdoor heat exchanger 5, and the cooling/heating switching valve 10. In this case, the indoor heat exchanger 8 may serve as a condenser, and the outdoor heat exchanger 4 may serve as an evaporator.

During the operation of the air conditioner, water is generated on the surface of the outdoor heat exchanger 4 or on the surface of the indoor heat exchanger 8. More specifically, if the air conditioner is an air cooler, water may be generated on the surface of the indoor heat exchanger 8. If the air conditioner is a heat pump and performs a cooling operation, water may be generated on the surface of the indoor heat exchanger 8. If the air conditioner is a heat pump and performs a heating operation, water may be generated on the surface of the outdoor heat exchanger 4. Such water on the surface of the outdoor heat exchanger 4 or the indoor heat exchanger 8 may freeze up at low temperature and may thus adversely affect the heat exchange performance of the air conditioner. Therefore, it is necessary to establish an atmosphere in which water on the surface of the outdoor heat exchanger 4 or the indoor heat exchanger 8 can be prevented from freezing even at low temperature.

The anti-freeze apparatus 20 prevents water on the surface of the outdoor heat exchanger 4 or the indoor heat exchanger 8 from freezing. If the air conditioner is an air cooler, the anti-freeze apparatus 20 may be disposed so that energy can be supplied to the indoor heat exchanger 8, and that water on the surface of the indoor heat exchanger 8 can be prevented from freezing. If the air conditioner is a heat pump, the anti-freeze apparatus 20 may be disposed so that energy can be supplied not only to the indoor heat exchanger 8 but also to the outdoor heat exchanger 8, and that water on the surface of the indoor heat exchanger 8 or the outdoor heat exchanger 4 can be prevented from freezing.

The anti-freeze apparatus 20 may prevent the freezing of water by using the phenomenon of super cooling, which is the cooling of a liquid below its freezing point without it becoming solid. The anti-freeze apparatus 20 may include a mechanical vibrator and thus prevent the freezing of water by applying mechanical vibrations to whichever of the outdoor heat exchanger 4 and the indoor heat exchanger 8 serves as an evaporator.

However, an anti-freeze apparatus 20 having a mechanical vibrator may damage the connections between a coolant pipe and whichever of the outdoor heat exchanger 4 and the indoor heat exchanger 8 serves as an evaporator, and thus may not be suitable for use in an air conditioner. Therefore, an anti-freeze apparatus 20 using the phenomenon of super cooling may be suitable for use in an air conditioner.

In general, when the temperature of an indoor room is below zero, it is more likely to perform a heating operation than to perform a cooling operation. Therefore, the anti-freeze apparatus 20 may supply energy so that water on the surface of the outdoor heat exchanger 4 can be prevented from freezing during a heating operation performed-by a heat pump. However, people from cold climates may feel hot even at temperatures below zero and may thus need a cooling operation. In this case, water on the surface of the indoor heat exchanger 8 may freeze due to such low temperatures. Therefore, it is necessary to prevent water on the surface of the indoor heat exchanger 8 from freezing by using the anti-freeze apparatus 20. By doing so, it is possible to improve the performance of a cooling operation. In addition, since the indoor heat exchanger 8 is cooled by the anti-freeze apparatus 20, it is possible to further improve the performance of a cooling operation.

The outdoor heat exchanger 4 is more likely to be frozen than the indoor heat exchanger 8 due to being exposed to low-temperature outside air. Thus, the operation of the anti-freeze apparatus 20 will hereinafter be described in further detail, focusing mainly on the prevention of water on the surface of the outdoor heat exchanger 4 from freezing during a heating operation of a heat pump.

The anti-freeze apparatus 20 includes an electrode unit 22 which generates an electric field and applies the electric field to the outdoor heat exchanger 4 and a voltage generation unit 28 which applies a voltage, and more particularly, a high-frequency alternating voltage, to the electrode unit 22.

The electrode unit 22 converts a high-frequency alternating voltage provided by the voltage generation unit 28 into an electric field, and applies the electric field to the outdoor heat exchanger 4. The electrode unit 22 may include plates or wires which are formed of a metal such as copper or platinum. More specifically, the electrode unit 22 includes a plurality of electrodes 24 and 26 which are disposed on the opposite sides of the outdoor heat exchanger 4.

An electric field generated by the electrode unit 22 is caused by a high-frequency alternating voltage. The polarity of the electric field varies according to the frequency of the high-frequency alternating voltage. Thus, the electric field constantly vibrates and rotates water molecules composed of oxygen with a negative polarity (−) and hydrogen with a positive polarity (+) so that water molecules can be prevented from being crystallized and can thus be maintained to be liquid even at temperatures below the freezing point of water.

The electrodes 24 and 26 may be surrounded by electrode covers 25 and 27, respectively, for safety. The electrode covers 25 and 27 may be formed of a dielectric material. The electrode covers 25 and 27 will be described later in detail.

The voltage generation unit 28 generates an alternating voltage according to setting values regarding a predetermined voltage magnitude and a predetermined frequency and applies the alternating voltage to the electrode unit 22. The voltage generation unit 28 may vary at least one of the magnitude and frequency of a voltage, thereby generating an alternating voltage. More specifically, the voltage generation unit 28 generates an alternating voltage according to setting values (e.g., setting values regarding a predetermined voltage magnitude and a predetermined frequency) provided by a control unit 32 and applies the alternating voltage to the electrode unit 22 so that the electrode unit 22 can generate an electric field and apply the electric field to the outdoor heat exchanger 4. The voltage generator 28 may vary the frequency of a voltage so that the magnitude of the voltage can vary within the range of 0.5-10 KV. The voltage generator 28 may vary the frequency of a voltage within a high-frequency range ranging from 0.5 kHz to 500 kHz.

The voltage generation unit 28 applies an alternating voltage having a high frequency of 0.5-500 kHz because a voltage having a frequency lower than 0.5 kHz or higher than 500 kHz can only slightly rotate or vibrate water molecules, thereby resulting in the phase transformation of water. A voltage having a magnitude greater than 10 KV may result in dielectric breakdown of the electrode covers 25 and 27. An alternating voltage having a frequency higher than 500 kHz may spread in the form of an electric wave, instead of generating an electric field. In addition, the speed at which the polarity of an alternating voltage having a frequency higher than 500 kHz varies may be excessively high so that the movement of water molecules cannot keep up with the variation of the polarity of the alternating voltage. Thus, the optimum frequency and the optimum voltage for a voltage generated by the voltage generation unit 28 may be set to the range of 0.5-500 kHz and the range of 0.5-10 KV, respectively.

If the outdoor heat exchanger 4 or the indoor heat exchanger 8 is a pin/tube-type heat exchanger including a coolant tube, which a coolant flows therethrough and is formed of aluminum or copper, and an aluminum pin, which is disposed in the coolant tube, an electric field generated by the electrode unit 22 may concentrate on the aluminum pin and generate heat due to the resistance of the aluminum pin. In general, when a voltage having a voltage of about 7000 V is applied to a stainless material as a direct current (DC) pulse, the stainless material emits negative ions, and the negative ions give an impulse to water molecules so that the water molecules can be prevented from freezing. By using this phenomenon, it is possible to prevent the freeze of water by applying a high voltage to the aluminum pin so that negative ions emitted from the aluminum pin can give an impulse to water molecules.

That is, it is possible to maintain an anti-freeze state by applying a high voltage to the aluminum pin. In addition, it is possible to reduce the probability of the occurrence of an electric shock by grounding the aluminum pin and providing an additional active electrode.

The air conditioner also includes a heat generation unit 30 which heats the outdoor heat exchanger 4 in addition to the anti-freeze apparatus 20 for preventing the freeze of water.

The heat generation unit 30 may be a controller which switches on or off the cooling/heating switching valve 10 so that, during a heating operation of a heat pump, a coolant of the heat pump can flow in the same manner as it does during a cooling operation. Alternatively, the heat generation unit 30 may be a hot-wire heater which directly applies heat to the outdoor heat exchanger 4. Still alternatively, the heat generation unit 30 may be an electric wave generator such as a magnetron which applies electric waves such as microwaves to the outdoor heat exchanger 4 and thus increases the temperature of the outdoor heat exchanger 4. For convenience, assume that the heat generation unit 30 is a hot-wire heater.

The heat generation unit 30 may be driven after the anti-freeze apparatus 20 is driven. Alternatively, the heat generation unit 30 and the anti-freeze apparatus 20 may be driven at the same time. Still alternatively, the heat generation unit 30 may be driven before the anti-freeze apparatus 20 is driven. In this case, the heat generation unit 30 may perform a defrost operation by generating heat, and may thus help the anti-freeze apparatus 20 prevent the freeze of water. If the heat generation unit 30 is used to generate heat after the operation of the anti-freeze apparatus 20 is terminated, the heat generation unit 30 may prevent the freeze of water in a super-cooling state and perform a defrost operation after the release of the super-cooling state. If the heat generation unit 30 is driven along with the anti-freeze apparatus 20, the heat generation unit 30 may perform a defrost operation by generating heat, and help the anti-freeze apparatus 20 prevent the freeze of water.

The air conditioner may also include the control unit 32, which controls the anti-freeze apparatus 20, and particularly, the voltage generation 28 and the heat generation unit 30, according to the state of operation of the air conditioner, and a load sensing unit 40, which detects the existence, the freeze, and the amount of water on the surface of the outdoor heat exchanger 4.

The load sensing unit 40 may include a temperature sensing unit which senses the temperature of a pipe connected to the outdoor heat exchanger 4, the temperature of the outdoor heat exchanger 4 or the temperature outside the room where the air conditioner is installed. More specifically, the load sensing unit 40 may include at least one of an outdoor heat exchanger temperature sensor 42 which senses the temperature of the outdoor heat exchanger 4, an inlet temperature sensor 44 which senses the temperature of a pipe at the inlet of the outdoor heat exchanger 4, an outlet temperature sensor 46 which senses the temperature of a pipe at the outlet of the outdoor heat exchanger 4, and an outdoor temperature sensor 48 which senses the temperature outside the air conditioner.

The control unit 32 may determine the existence, the freeze, and the amount of water on the surface of the outdoor heat exchanger 4 based on the result of the sensing performed by at least one of the outdoor heat exchanger temperature sensor 42, the inlet temperature sensor 44, the outlet temperature sensor 46, and the outdoor temperature sensor 48. Then, the control unit 32 may determine whether to drive the voltage generation unit 28 and determine a frequency and a voltage magnitude for the voltage generation unit 28. In addition, the control unit 32 may determine whether to drive the heat generation unit 30 and determine a control temperature for the heat generation unit 30.

The control unit 32 may control the anti-freeze apparatus 20 not only by using the load sensing unit 40 but also by taking into consideration whether the air conditioner performs a heating operation. The control of the anti-freeze apparatus 20 by the control unit 32 will hereinafter be described in further detail.

If the air conditioner satisfies a set of anti-freeze initiation conditions, the control unit 32 may drive the anti-freeze apparatus 20. On the other hand, if the air conditioner satisfies a set of anti-freeze release conditions, the control unit 32 may terminate the operation of the anti-freeze apparatus 20.

The anti-freeze initiation conditions are the conditions in which water is generated on the surface of the outdoor heat exchanger 4 and is likely to freeze. The anti-freezing initiation conditions may include at least one of the following conditions: whether the air conditioner performs a heating operation, the amount of time for which long the compressor 2 of the air conditioner has been continuously driven, a water load condition, and an elapsed time after the initiation of an anti-freezing operation.

For example, if the air conditioner performs a heating operation, the compressor 2 has been continuously driven for more than a predefined amount of time, the temperature of the outdoor heat exchanger 4 is lower than a reference temperature, and a predefined amount of time has not yet elapsed since the initiation of an anti-freeze operation, the anti-freeze apparatus 20 may be driven. On the other hand, if the air conditioner performs an operation, other than a heating operation, the compressor 2 has been continuously driven, but for less than a predefined amount of time, the temperature of the outdoor heat exchanger 4 is higher than a reference temperature, and a predefined amount of time has already elapsed since the initiation of an anti-freeze operation, the anti-freeze apparatus 20 may not be driven.

The anti-freeze release conditions are the conditions in which an anti-freeze operation is unnecessary because no water is generated on the surface of the outdoor heat exchanger 4 or because water, if any, on the surface of the outdoor heat exchanger 4 is less likely to freeze. The anti-freeze release conditions include at least one of the following conditions: whether the air conditioner performs a heating operation and a water load condition.

For example, if a heating operation performed by the air conditioner is terminated during the operation of the anti-freeze apparatus 20 or if the temperature of the outdoor heat exchanger 4 is higher than a reference temperature, the operation of the anti-freeze apparatus 20 may be terminated.

In addition, if the air conditioner performs a heating operation, the compressor 2 has been continuously driven for more than a predefined amount of time, and the temperature of the outdoor heat exchanger 4 is lower than a reference temperature, the anti-freeze apparatus 20 may be driven regardless of an elapsed time after the initiation of an anti-freeze operation. On the other hand, if the air conditioner performs an operation, other than a heating operation, the compressor 2 has been continuously driven, but for less than a predefined amount of time, and the temperature of the outdoor heat exchanger 4 is higher than a reference temperature, the anti-freeze apparatus 2 may not be driven. If a heating operation performed by the air conditioner is terminated during the operation of the anti-freeze apparatus 20 or if the temperature of the outdoor heat exchanger 4 is higher than a reference temperature, the operation of the anti-freeze apparatus 20 may be terminated.

Referring to FIG. 1, reference numeral 3 indicates an accumulator which is disposed between the compressor 2 and a suction tube 2*a* and in which a coolant accumulates; reference numeral 5 indicates an outdoor blower 5 which includes an outdoor fan 5*a* that blows air into the outdoor heat exchanger 4 and a motor 5*b* that rotates the outdoor fan 5*a*; and reference numeral 9 indicates an indoor blower 5 which includes an outdoor fan 9*a* that blows air into the indoor heat exchanger 9 and a motor 9*b* that rotates the outdoor fan 9*a*. Referring to FIG. 2, reference numeral 50 indicates a control panel or an input unit of a remote control which is installed in an indoor unit 1 of FIG. 1 and enables a user to select various operating modes and an anti-freeze operation.

The embodiment of FIGS. 1 and 2 may be applied not only to an integral-type air conditioner in which an indoor unit and an outdoor unit are both integrated in one case but also to a separate-type air conditioner in which an indoor unit and an outdoor unit are separate. Assume that the air conditioner of the embodiment of FIGS. 1 and 2 is a separate-type air conditioner, and that the anti-freeze apparatus 20 is disposed in an outdoor unit O of the air conditioner illustrated in FIG. 1.

Figure 3:
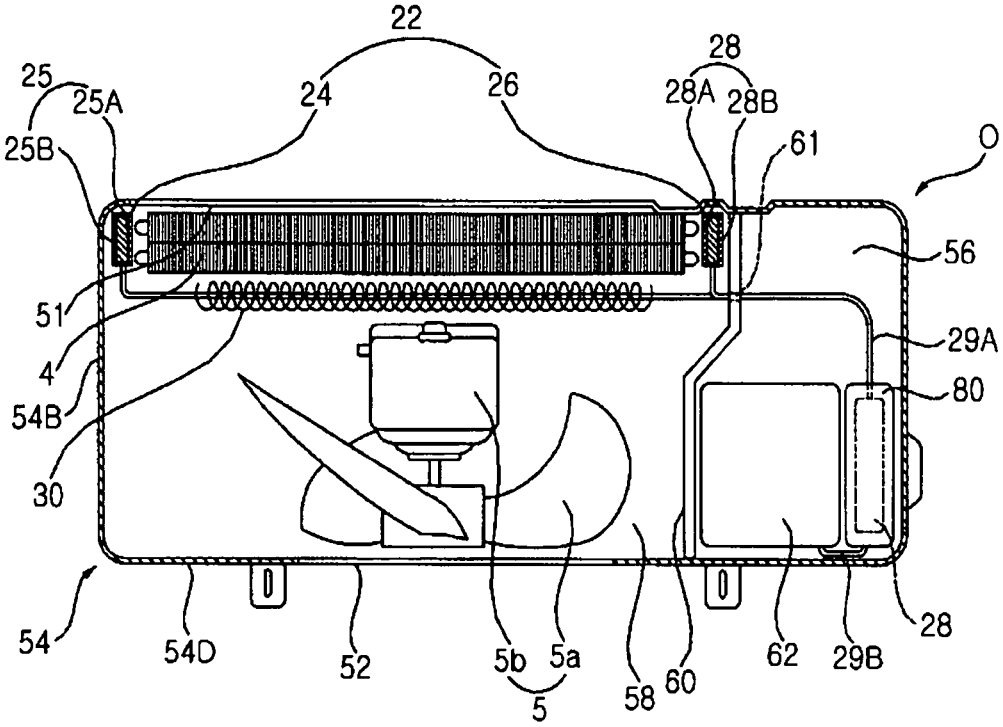
FIG. 3 illustrates a plan view of an outdoor unit of the air conditioner illustrated in FIG. 1.
Figure 4:
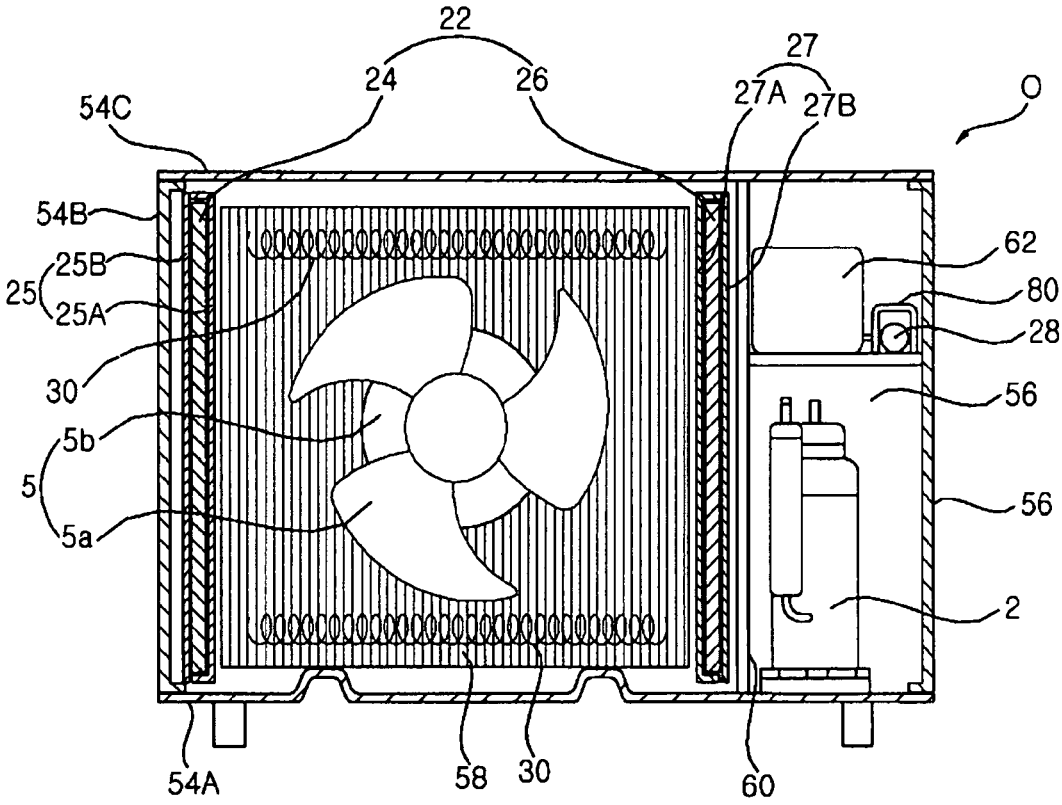
FIG. 4 illustrates a front view of the outdoor unit illustrated in FIG. 3.

FIG. 3 illustrates a plan view of the outdoor unit O, and FIG. 4 illustrates a front view of the out door unit O illustrated in FIG. 3.

Referring to FIGS. 3 and 4, the outdoor unit O includes a casing 54 which has an air inlet 51 and an air outlet 52 through which air is injected into and ejected from the casing 54; and a barrier wall 60 which is divides the inner space of the casing 54 into a machine room 56 and a flow path room 58. The compressor 2 is disposed in the machine room 56, and the outdoor heat exchanger 4 is disposed in the flow path room 58.

The accumulator 3 and the expansion device 6 are disposed in the machine room 56 of the outdoor unit O along with the compressor 2.

The casing 54 includes a base 54A which has legs; a cabinet 54B which is disposed on the base 54A and has an air inlet 51 disposed on at least one surface of the cabinet 54B; a front cover 54C which is disposed at the front of the cabinet 54B and has an air outlet 52; and a top cover 54D which covers the top of the cabinet 54B.

The casing 54 may be entirely formed of a dielectric material. Alternatively, only the portions of the casing 54 near the electrodes 24 and 26 may be formed of a dielectric material.

The outdoor unit O may be installed so that the outdoor heat exchanger 4 can become in the vicinity of the air inlet 51. Only the cabinet 54B of the outdoor unit O, which is adjacent to the outdoor heat exchanger 4, may be formed of a dielectric material. Alternatively, the cabinet 54B and the top cover 54D may be formed of a dielectric material, whereas the base 54A, which needs to have high rigidity, and the front cover 54C, which is relatively distant apart from the electrode unit 22, may be formed of a highly rigid material.

The outdoor blower 5 is disposed in the outdoor unit O. The outdoor fan 5A of the outdoor blower 5 is disposed in the flow path room 58 and between the air inlet 51 and the air outlet 52 so that air can be injected into the outdoor unit O through the air inlet 51 and ejected from the outdoor unit O through the air outlet 52.

The heat generation unit 30, i.e., a hot-wire heater, is installed in the outdoor unit O. The heat generation unit 30 may be disposed in a location hidden by the outdoor heat exchanger 4 for safety.

More specifically, the heat generation unit 30 may be distant apart from an electric field zone, which is an area affected by an electric field generated by the electrodes 24 and 26, so that the influence of the electric field on the heat generation unit 30 can be prevented or at least minimized. In addition, the heat generation unit 30 may be disposed at the front or the rear of the space between the electrodes 24 and 26 so that the influence of heat generated by the heat generation unit 30 on the electrodes 24 and 28 can be prevented or at least minimized.

The barrier wall 60 may be formed of a dielectric material.

The outdoor unit O also includes a control box 62 in which various automotive electric elements of the control unit 32 such as automotive electric elements for controlling the compressor 2 are installed. The control box 62 may be disposed either in the machine room 56 or in the flow path room 58.

The control box 62 may be disposed above the machine room 56. All or some of the automotive electric elements of the control unit 32 may be installed in the control box 62.

The electrode unit 22, including the electrodes 24 and 26, is disposed in the flow path room 56.

The electrodes 24 and 26 may be disposed not to block the passage of the flow of air from the outside of the outdoor unit O and thus not to interrupt with the flow of air. The electrodes 24 and 26 may be disposed on the left and right sides, respectively, of the outdoor heat exchanger 4. Alternatively, the electrodes 24 and 26 may be disposed above and below, respectively, the outdoor heat exchanger 4. In this case, the electrodes 24 and 26 may be vertically aligned with each other or may be disposed diagonally with respect to the outdoor heat exchanger 4.

The electrode covers 25 and 27 may be electrode housings and cover the electrodes 24 and 26, respectively. The electrode covers 25 and 27 may be formed of a dielectric material such as plastic.

The electrode covers 25 and 27 may include electrode boxes 25A and 27A, respectively, and covers 25B and 27B, respectively. Each of the electrode boxes 25A and 27A has one surface opened and may thus be able to hold the electrode 24 or 26. The covers 25B and 27B respectively cover the opened surfaces of the electrode boxes 25A and 27B. Alternatively, the electrode covers 25 and 27 may be formed as housings through injection molding so that the electrodes 24 and 26 can be inserted into the electrode covers 25 and 27, respectively.

The voltage generation unit 28 may be disposed in the machine room 56 or may be disposed in the flow path room 56 along with the electrode unit 22.

If the voltage generation unit 28 is disposed in the machine room 56, the probability of the voltage generation unit 28 malfunctioning due to an electric field may be minimized, and the voltage generation unit 28 may be easily controlled and serviced due to being adjacent to the control box 62. On the other hand, if the voltage generation unit 28 is disposed in the flow path room 58, heat generated by the voltage generation unit 28 may be dissipated due to air that passes through the flow path room 58, and thus, the stability of the voltage generation unit 28 may be improved.

The voltage generation unit 28 is connected to the electrode unit 22 through a wire 29A and is connected to the control box 62 through a wire 29B. Thus, if the voltage generation unit 28 is disposed in the machine room 56, the wire 29A may pass through the barrier wall 60 or make a detour round the barrier wall 60. On the other hand, if the voltage generation unit 28 is disposed in the flow path room 56, the wire 29B may pass through the barrier wall 60 or make a detour round the barrier wall 60.

A wire through groove or a wire through hole 61 via which at least one of the wires 29A and 29B can pass through the barrier wall 60 may be formed on the barrier wall 60.

Referring to FIGS. 3 and 4, reference numeral 80 indicates a dielectric element which covers the voltage generation unit 28 for the safety of the voltage generation unit 28.

Figure 5:
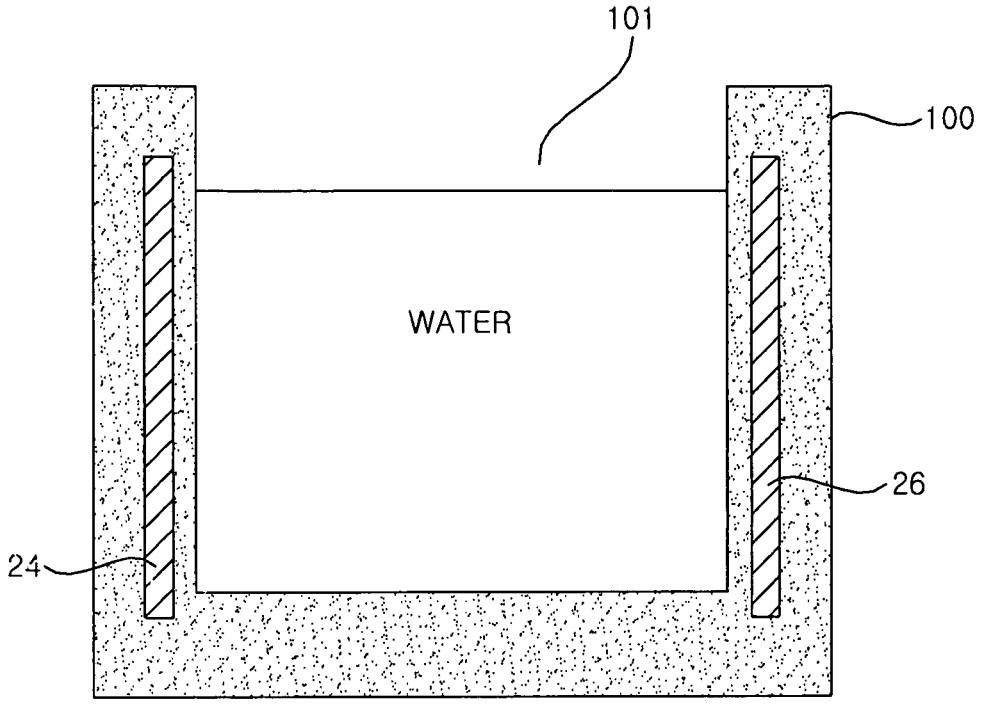
FIG. 5 illustrates a structure for experimenting a super-cooling phenomenon of an air conditioner according to an embodiment of the present invention.

FIG. 5 illustrates a structure for testing a super-cooling phenomenon of an air conditioner according to an embodiment of the present invention.

Referring to FIG. 5, a space 101 for containing water therein is formed in a case 100. 0.1 l of distilled water is contained in the space 101. A plurality of electrodes 24 and 26 are installed inside the case 100 and are disposed at the opposite sides of the space 101. The length of the electrodes 24 and 26 is greater than the height of water in the space 101. The width of the electrodes 24 and 26 is 20 mm. The case 100 is formed of a dielectric material such as an acrylic material. An alternating voltage of 0.91 KV (6.76 mA, 20 kHz) is applied to the electrodes 24 and 26 using a voltage generation unit 28, and the case 100 is cooled so that the temperature in the space 101 can reach about −7° C.

Figure 6:
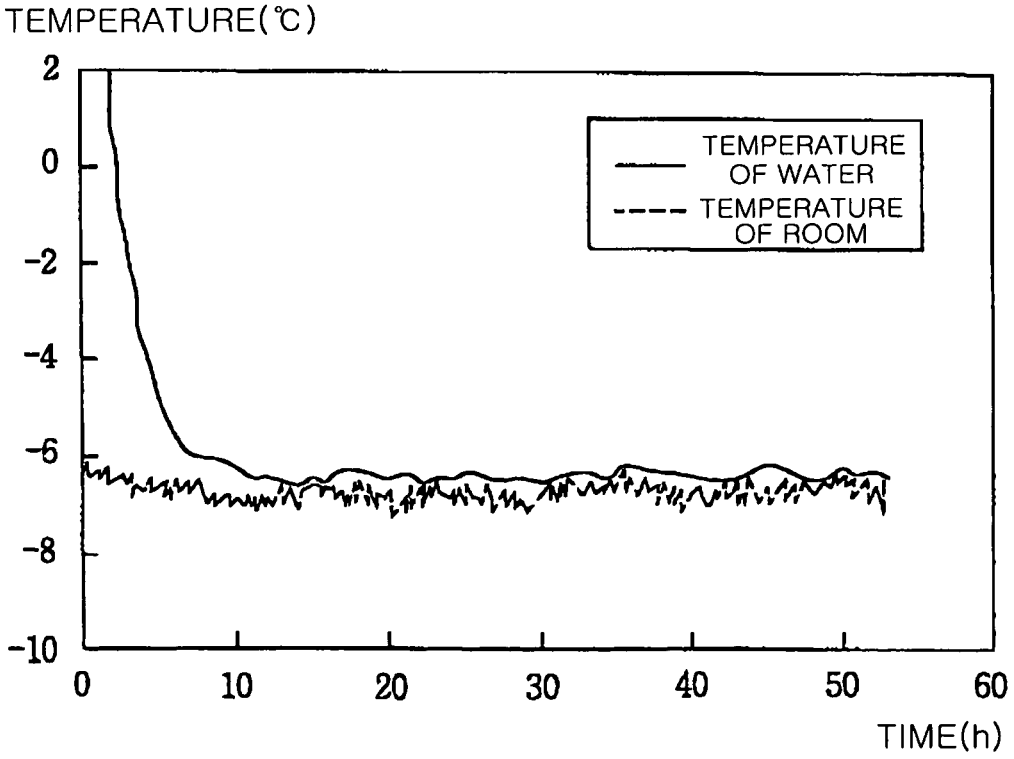
FIG. 6 illustrates a graph of super-cooling measurement results obtained using the structure illustrated in FIG. 5.
Figure 7:
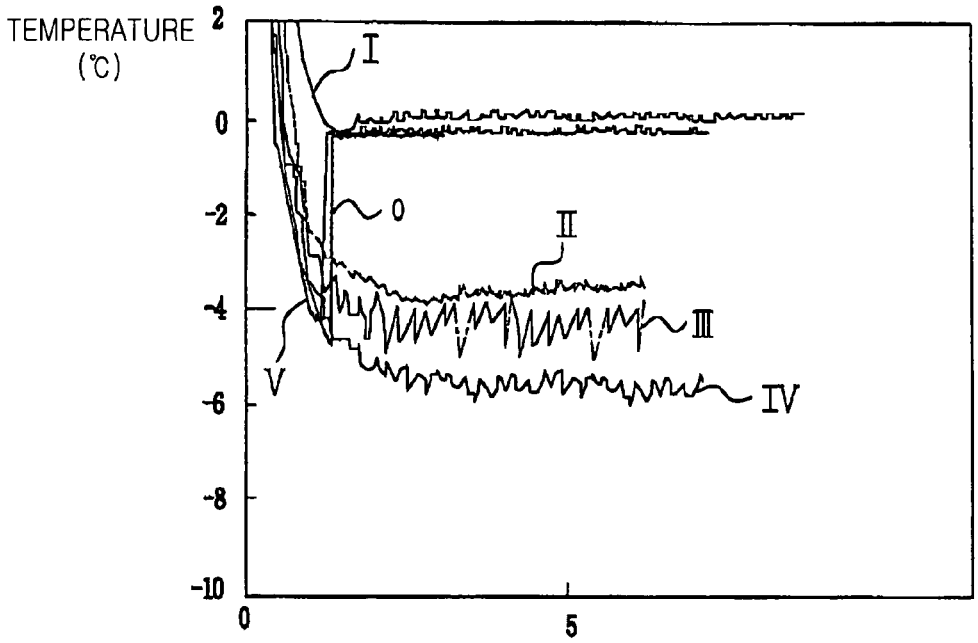
FIG. 7 illustrates a graph of anti-freeze temperature measurements for different amounts of power obtained using the structure illustrated in FIG. 5.

FIG. 6 illustrates a graph of experimental results obtained using the structure illustrated in FIG. 5, and FIG. 7 illustrates a graph of anti-freeze temperature measurement results for different amounts of power obtained using the structure illustrated in FIG. 5. The measurement results of FIG. 7 were obtained by maintaining the temperature of the space 101 of the case 100 at −6° C., setting a plurality of amounts of power to be applied by the voltage generation unit 28, and applying the plurality of amounts of power. Referring to a reference line O of FIG. 7, when no power is applied, an anti-freeze state is maintained until the temperature of the space 101 reaches −5° C. Then, a freeze state begins less than three hours after the onset of the anti-freeze state.

Referring to a first energy line I (1.38 W) of FIG. 7, since a large amount of energy is applied to water, the temperature of water is almost uniformly maintained at 0° C., and thus, super cooling does not occur even if water begins to freeze at its freezing point (a temperature of 0° C. at a pressure of 1 atm).

Referring to a second energy line II (0.98 W) of FIG. 7, an anti-freeze state caused by a super cooling phenomenon is maintained, and an anti-freeze temperature is maintained within the range of −3° C. and −3.5° C.

Referring to a third energy line III (0.91 W) of FIG. 7, an anti-freeze state caused by a super cooling phenomenon is maintained, and an anti-freeze temperature is maintained within the range of −4° C. and −5° C.

Referring to a fourth energy line IV (0.62 W) of FIG. 7, an anti-freeze state caused by a super cooling phenomenon is maintained, and an anti-freeze temperature is maintained within the range of −5.5° C. and −5.8° C.

Referring to a fifth energy line V (0.36 W), no super cooling state is achieved, so water freezes, i.e., a phase transition of water occurs.

Figure 8:
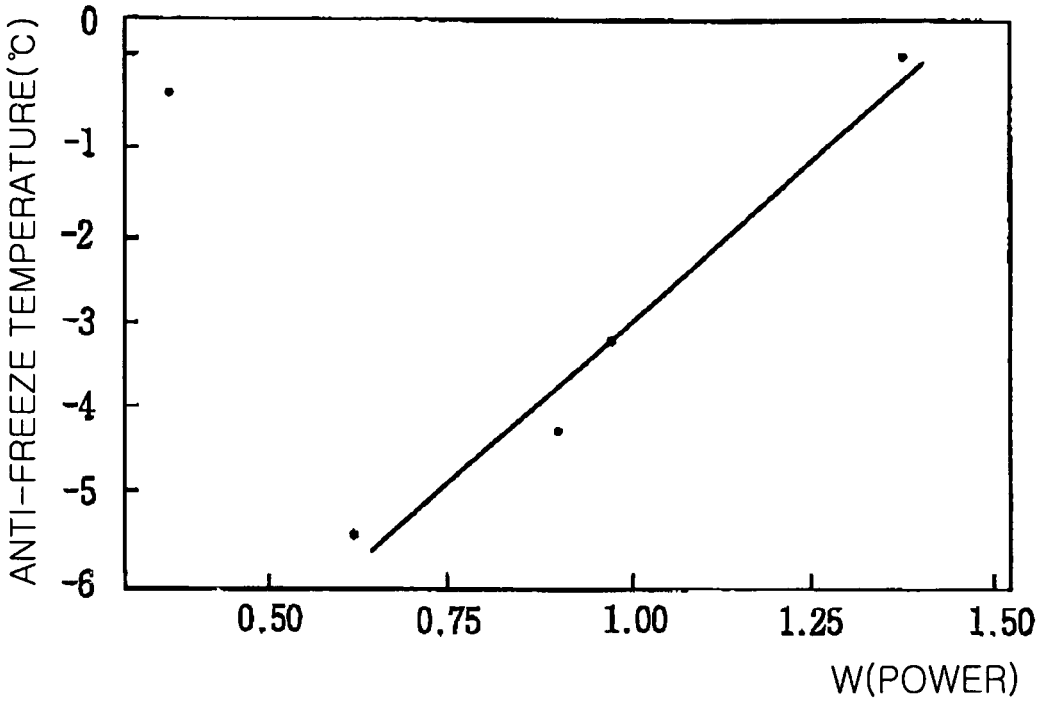
FIG. 8 illustrates a graph of the correlation between first through fifth energy lines illustrated in FIG. 7.

FIG. 8 illustrates a graph of the correlation between the first through fifth energy lines illustrated in FIG. 7. Referring to FIG. 8, the amount of energy applied to water is proportional to an anti-freeze temperature of water. The greater the amount of energy applied to water, the higher the anti-freeze temperature becomes. On the other hand, the less the amount of energy applied to water, the lower the anti-freeze temperature becomes. However, if too little energy is applied, the motion of water molecules may not be active enough to realize a super cooling state, and thus, water may freeze, as in the case of the fifth energy line of FIG. 7.

Figure 9:
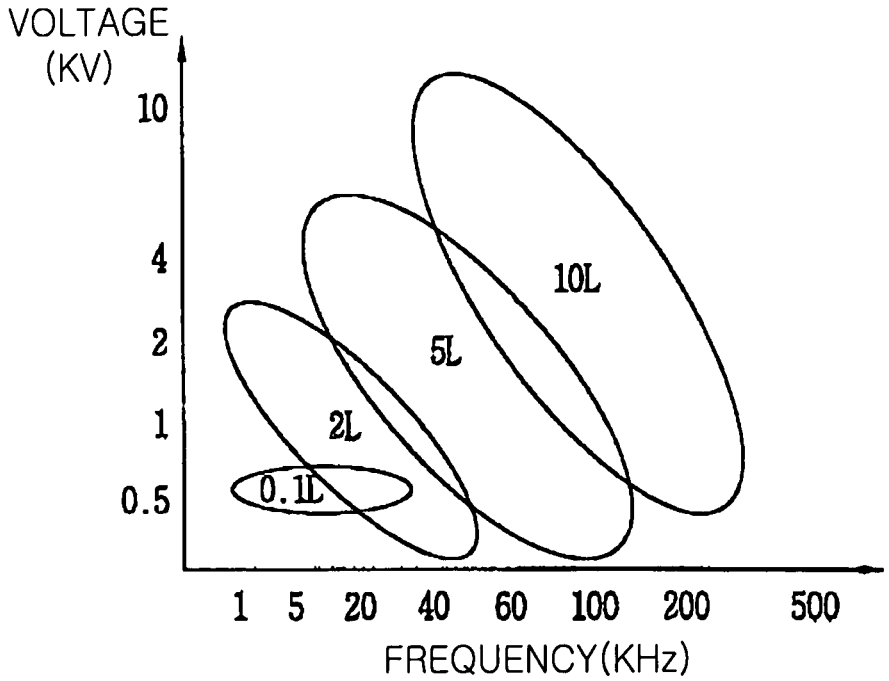
FIG. 9 illustrates a graph of the relationships between a voltage and a frequency for maintaining an anti-freeze state for different amounts of water in an air conditioner.

FIG. 9 illustrates a graph of the relationship between an optimum voltage and an optimum frequency band for maintaining an anti-freeze state for different amounts of water in an air conditioner. Referring to FIG. 9, the optimum voltage and an optimum frequency band for maintaining an anti-freeze state must be appropriately determined in accordance with an increase in the amount of water, for example, from 0.1 l to 2 l, from 2 l, to 5 l or from 5 l to 10 l. If the optimum frequency band and the optimum voltage are set to the range of 0.5-500 kHz and the range of 0.5-10 KV, respectively, an anti-freeze state of water may be effectively maintained regardless of a variation in the amount of water. Given that, in general, less than 0.1 l of condensed water is generated regardless of the size of the outdoor heat exchanger 4, the optimum frequency band and the optimum voltage may be set to the range of 0.5-40 kHz and the range of 0.5-1 KV, respectively.

The operation of the air conditioner of the embodiment of FIGS. 1 and 2 will hereinafter be described in further detail.

Figure 10:
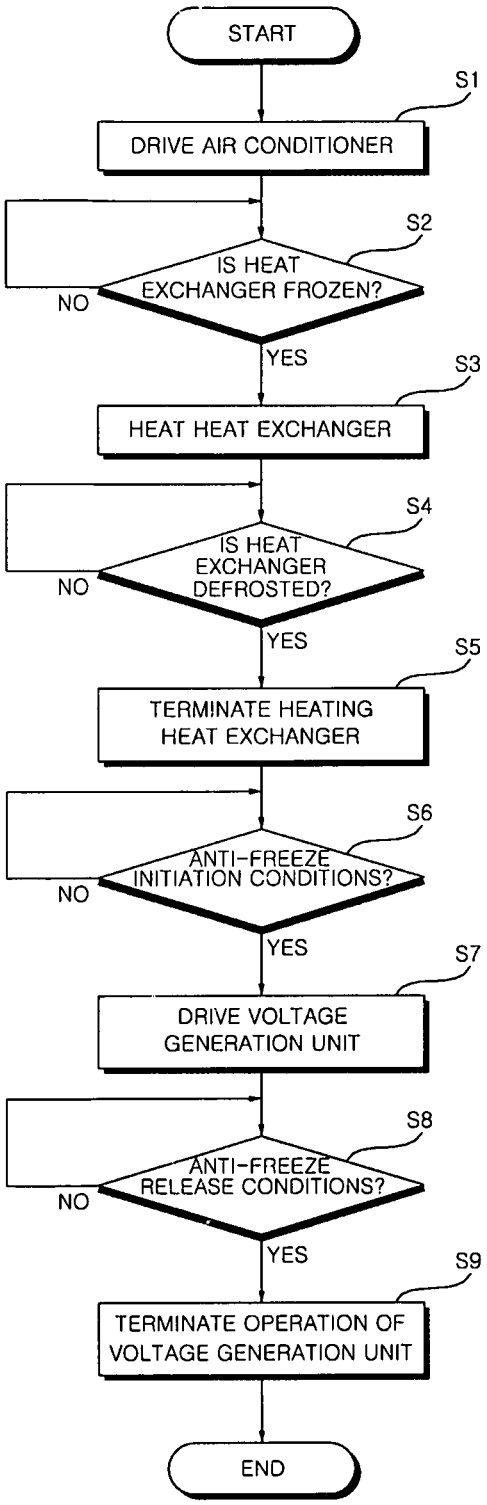
FIG. 10 illustrates a flowchart of a method of controlling an air conditioner according to an embodiment of the present invention.

FIG. 10 illustrates a flowchart of a method of controlling an air conditioner according to an embodiment of the present invention. Referring to FIG. 10, during a cooling operation of the air conditioner, the control unit 32 drives the compressor 2, controls the cooling/heating switching valve 10 to operate in a cooling mode, and drives the motor 9B of the indoor blower 9 and the motor 5B of the outdoor blower 5 (S1).

During a cooling operation of the air conditioner, a coolant sequentially passes through the outdoor heat exchanger 4, the expansion device 6, the indoor heat exchanger 8 and the compressor 2, the indoor heat exchanger 8 removes heat from air in a room in which the air conditioner is installed, and the outdoor heat exchanger 4 releases the heat to the outside of the room while On the other hand, during a heating operation of the air conditioner, the control unit 32 drives the compressor 2, controls the cooling/heating switching valve 10 to operate in a heating mode, and drives the motor 9B of the indoor blower 9 and the motor 5B of the outdoor blower 5.

During a heating operation of the air conditioner, a coolant sequentially passes through the compressor 2, the indoor heat exchanger 8, the expansion device 6, the outdoor heat exchanger 4 and the compressor 2, the outdoor heat exchanger 4 removes heat from air the outside of the room and the outdoor heat exchanger 4 releases the heat into the room (S1).

During a heating operation of the air conditioner, condensed water is generated on the surface of the outdoor heat exchanger 4, and the temperature sensing unit 40 senses the temperature of the outdoor heat exchanger 4 or a pipe connected to the outdoor heat exchanger 4 or the temperature outside the room, and outputs the result of the sensing to the control unit 32. Then, the control unit 32 determines whether the water on the surface of the outdoor heat exchanger 4 is frozen based on the result of the sensing performed by the temperature sensing unit 40. Assume that the temperature sensing unit 40 senses the temperature of the outdoor heat exchanger 5 and outputs the result of the sensing to the control unit 32.

The control unit 32 determines that water on the surface of the outdoor heat exchanger 4 is frozen if the voltage detection performed by the temperature sensing unit 40 is lower than a defrost initiation temperature (e.g., the freezing point of water) (S2). Then, the control unit 32 drives the heat generation unit 30. That is, the control unit 32 may apply a current to a hot-wire heater or perform a defrost operation (S3). Assume that the control unit 32 applies a current to a hot-wire heater.

The heat generation unit 30 generates heat due to the current applied thereto. Then, the temperature of the outdoor heat exchanger 4 increases, and frost on the surface of the outdoor heat exchanger 4 melts.

During such defrost operation, the outdoor heat exchanger temperature sensor 42 keeps measuring the temperature of the outdoor heat exchanger 4 and outputs the result of the measurement to the control unit 32. Then, if the result of the measurement performed by the outdoor heat exchanger temperature sensor 42 is higher than a heating release temperature (e.g., a temperature 5° C. higher than the freezing point of water) (S4), the control unit 32 determines that the frost on the surface of the outdoor heat exchanger 4 has melted sufficiently, and terminates the operation of the heat generation unit 30 (S5). That is, the control unit 32 cuts off the current applied to a hot-wire heater.

Thereafter, the control unit 32 determines whether the outdoor heat exchanger 4 satisfies a set of anti-freeze initiation conditions. If the outdoor heat exchanger 4 satisfies the anti-freeze initiation conditions (S6), the control unit 32 drives the anti-freeze apparatus 20 (S7).

For example, if the air conditioner is currently performing a heating operation, the compressor 2 has been continuously driven for more than a predefined amount of time (e.g., for more than ten minutes), and water on the surface of the outdoor heat exchanger 4 has been defrosted by the heat generation unit 30, the control unit 32 may determine that the outdoor heat exchanger 4 satisfies the anti-freeze initiation conditions. Then, the control unit 32 drives the anti-freeze apparatus 20.

More specifically, the control unit 32 controls the voltage generation unit 28 to apply a voltage having a predefined magnitude and belonging to a predefined frequency band to the electrodes 24 and 26. Then, an electric field is generated between the electrodes 24 and 26 of the electrode unit 22.

The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

During the operation of the anti-freeze apparatus 20, the control unit 32 lowers the operating capacity of the air conditioner, and particularly, the operating capacity of the compressor 2 and the expansion device 6, so that severe temperature variations can be prevented, and that an anti-freeze operation can be stably performed.

When a predefined amount of time (e.g., three minutes) elapses after the initiation of the operation of the anti-freeze apparatus 20, the control unit 32 controls the voltage generation unit 28 to reduce the frequency of the voltage applied to the electrodes 24 and 26 of the electrode unit 22 and thus to reduce the power consumption of the air conditioner. The predefined amount of time is the time taken to stabilize an anti-freeze state and may be experimentally determined. Once the anti-freeze state is stabilized, the motion in water molecules becomes regular and thus becomes less affected by a reduction in the frequency of the voltage applied to the electrodes 24 and 26. Therefore, the anti-freeze state can be uniformly maintained.

The control unit 32 terminates the operation of the anti-freeze apparatus 20 if the outdoor heat exchanger 4 satisfies a set of anti-freeze release conditions (S8 and S9).

For example, if a heating operation of the air conditioner is terminated during the operation of the anti-freeze apparatus 20 or if the temperature of the outdoor heat exchanger 4 is higher than a reference temperature (e.g., a temperature 5° C. higher than the freezing point of water), the control unit 32 may terminate the operation of the anti-freeze apparatus 20.

In other words, the control unit 32 cuts off the voltage applied to the electrodes 24 and 26 of the electrode unit 22 so that no electric field can be generated in the outdoor heat exchanger 4 any longer.

Alternatively, the inlet temperature sensor 44 may sense the temperature of the inlet of the outdoor heat exchanger 4 and output the result of the sensing to the control unit 32, and the outlet temperature sensor 46 may sense the temperature of the outlet of the outdoor heat exchanger 4 and output the result of the sensing to the control unit 32. Then, the control unit 32 compares the difference between the temperatures of the inlet and the outlet of the outdoor heat exchanger 4 with a reference value and determines whether water, if any, on the surface of the outdoor heat exchanger 4 is frozen based on the result of the comparison. More specifically, if the difference between the temperatures of the inlet and the outlet of the outdoor heat exchanger 4 is less than the reference value, the control unit 32 may determine that water on the surface of the outdoor heat exchanger 4 is frozen. On the other hand, if the difference between the temperatures of the inlet and the outlet of the outdoor heat exchanger 4 is the same as or greater than the reference value, the control unit 32 may determine that water on the surface of the outdoor heat exchanger 4 is not frozen.

Still alternatively, the outdoor temperature sensor 48 may sense the temperature outside the room where the air conditioner is installed, and output the result of the sensing to the control unit 32. Then, the control unit 32 compares the result of the sensing performed by the outdoor temperature sensor 48 with a reference value and determines whether water, if any, on the surface of the outdoor heat exchanger 4 is frozen based on the result of the comparison. More specifically, if the result of the sensing performed by the outdoor temperature sensor 48 is less than the reference value, the control unit 32 may determine that water on the surface of the outdoor heat exchanger 4 is frozen. On the other hand, if the result of the sensing performed by the outdoor temperature sensor 48 is the same as or greater than the reference value, the control unit 32 may determine that water on the surface of the outdoor heat exchanger 4 is not frozen.

Figure 11:
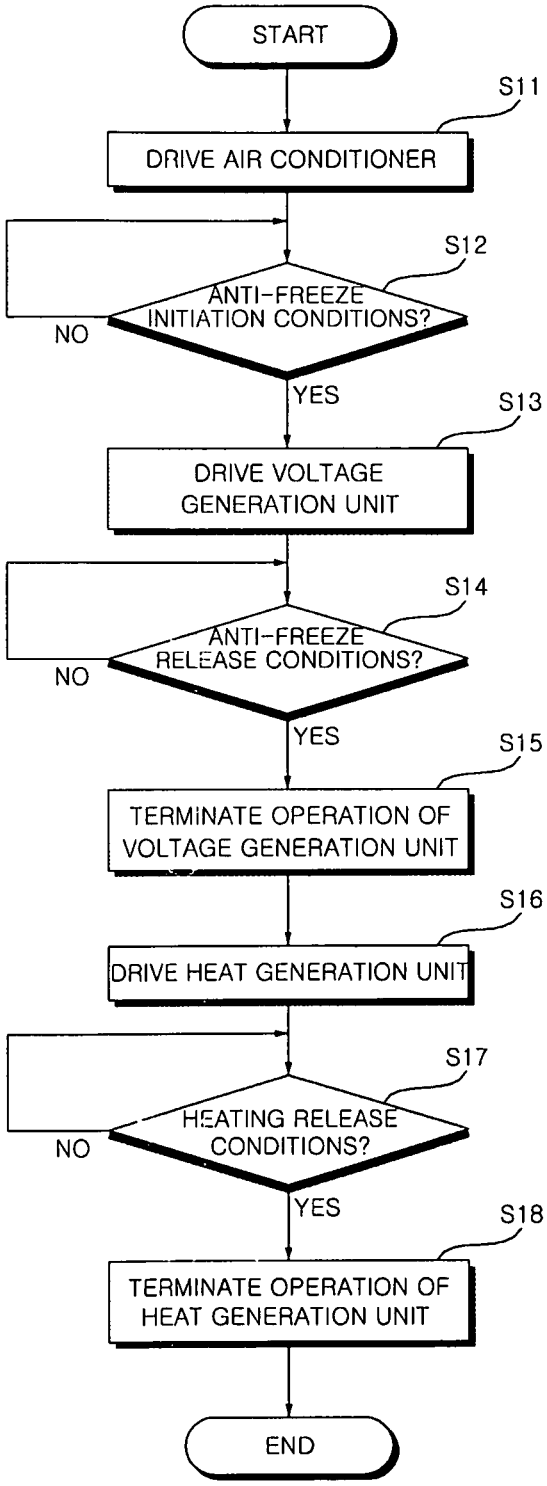
FIG. 11 illustrates a flowchart of a method of controlling an air conditioner according to another embodiment of the present invention.

FIG. 11 illustrates a method of controlling an air conditioner according to another embodiment of the present invention. Referring to FIG. 11, during an operation of an air conditioner, the control unit 32 determines whether the outdoor heat exchanger 4 satisfies a set of anti-freeze initiation conditions. If the outdoor heat exchanger 4 satisfies the anti-freeze initiation conditions, the anti-freeze apparatus 200 is driven (S13).

For example, if the air conditioner is currently performing a heating operation, the compressor 2 has been continuously driven for more than a predefined amount of time (e.g., for more than ten minutes), and the temperature of the outdoor heat exchanger 4 or a temperature measurement provided by the temperature sensing unit 40 is lower than a reference temperature (e.g., a temperature 2° C. higher than the freezing point of water), the control unit 32 may drive the anti-freeze apparatus 20.

More specifically, the control unit 32 controls the voltage generation unit 28 to apply a voltage having a predefined magnitude and belonging to a predefined frequency band to the electrodes 24 and 26. Then, an electric field is generated between the electrodes 24 and 26 of the electrode unit 22.

The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

In other words, the air conditioner can perform a heating operation while preventing water on the surface of the outdoor heat exchanger 4 from freezing. Thus, there is no need to perform a defrost operation during a heating operation of the air conditioner.

The control unit 32 terminates the operation of the anti-freeze apparatus 20 if the air conditioner satisfies a set of anti-freeze release conditions (S14 and S15).

For example, if a heating operation of the air conditioner is terminated during the operation of the anti-freeze apparatus 20, the control unit 32 may terminate the operation of the anti-freeze apparatus 20.

In other words, the control unit 32 cuts off the voltage applied to the electrodes 24 and 26 of the electrode unit 22 so that no electric field can be generated in the outdoor heat exchanger 4 any longer.

Thereafter, the control unit 32 drives the heat generation unit 30 in order to prevent water on the surface of the outdoor heat exchanger 4 from freezing (S16).

That is, water on the surface of the outdoor heat exchanger 4 is highly likely to freeze up as soon as an electric field disappears from the outdoor heat exchanger 4. Once the water on the surface of the outdoor heat exchanger 4 is frozen, the performance of a heating operation of the air conditioner deteriorates. Thus, in order to address this, the outdoor heat exchanger 4 is heated before performing a heating operation.

Heat generated by the heat generation unit 30 increases the temperature of the outdoor heat exchanger 4, and thus, the temperature of water on the surface of the outdoor heat exchanger 4 rapidly increases so that the water on the surface of the outdoor heat exchanger 4 can be prevented from freezing.

Thereafter, if the air conditioner satisfies a set of heating release conditions, the control unit 32 terminates the operation of the heat generation unit 30 (S17 and S18).

For example, if the temperature of the outdoor heat exchanger 4 reaches a heating release temperature (e.g., a temperature 5° C. higher than the freezing point of water) or if the heat generation unit 30 has been continuously driven for more than a predetermined amount of time set for heating, the control unit 32 determines that the outdoor heat exchanger 4 has been heated sufficiently, and terminates the operation of the heat generation unit 30.

Figure 12:
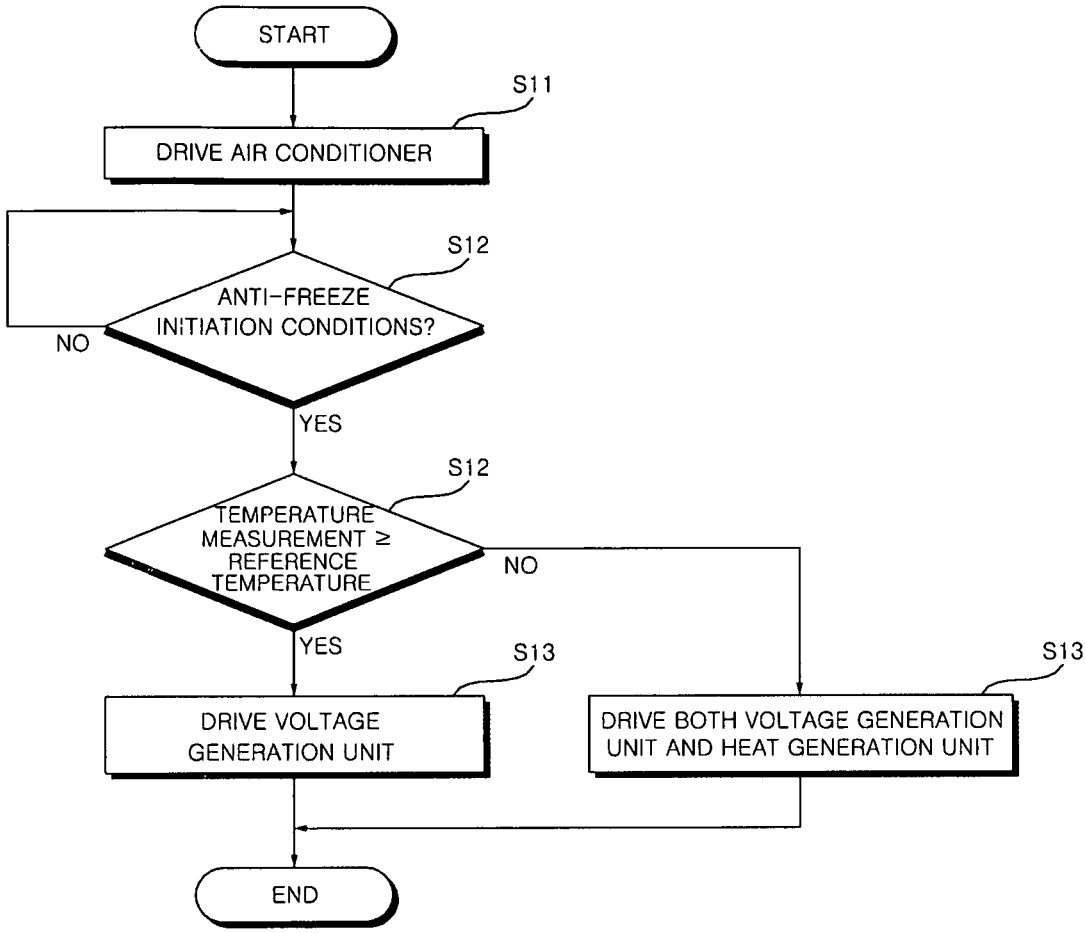
FIG. 12 illustrates a flowchart of a method of controlling an air conditioner according to another embodiment of the present invention.

FIG. 12 illustrates a flowchart of a method of controlling an air conditioner according to another embodiment of the present invention. Referring to FIG. 12, during an operation of an air conditioner, the control unit 32 determines whether the outdoor heat exchanger 4 satisfies a set of anti-freeze initiation conditions (S21 and S22).

For example, if the air conditioner is currently performing a heating operation, the compressor 2 has been continuously driven for more than a predefined amount of time (e.g., for more than ten minutes, the control unit 32 may determine that the outdoor heat exchanger 4 satisfies the anti-freeze initiation conditions. Otherwise, the control unit 32 may determine that the outdoor heat exchanger 4 do not satisfy the anti-freeze initiation conditions.

If it is determined that the outdoor heat exchanger 4 satisfies the anti-freeze initiation conditions, the control unit 32 may decide whether to perform an anti-freeze operation alone or to perform both an anti-freeze operation and a heating operation based on a temperature measurement provided by the temperature sensing unit 40.

More specifically, if the temperature of the outdoor heat exchanger 4 or a temperature measurement provided by the temperature sensing unit 40 is higher than a reference temperature (e.g., the freezing point of water), the control unit 32 may decide to perform an anti-freeze operation alone, and drive the anti-freeze apparatus 20, and particularly, the voltage generation unit 28 (S23 and S24).

In the embodiment of FIG. 12, like the embodiments of FIGS. 10 and 11, an electric field is generated between the electrodes 24 and 26 of the electrode unit 22 as a result of the operation of the voltage generation unit 28. The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

On the other hand, if the temperature of the outdoor heat exchanger 4 or the temperature measurement provided by the temperature sensing unit 40 is lower than the reference temperature (e.g., the freezing point of water), the control unit 32 may decide to perform both an anti-freeze operation and a heating operation, and drive both the anti-freeze apparatus 20 and the heat generation unit 30 (S23 and S25).

The operation of the heat generation unit 30 may be performed by turning on a hot-wire heater or operating the air conditioner in a defrost mode.

As a result of the operation of the heat generation unit 30, the temperature of the outdoor heat exchanger 4 increases due to heat generated by the heat generation unit 30, and thus, frost on the surface of the outdoor heat exchanger 4 melts. In addition, the voltage generation unit 28 applies a voltage having a predetermined magnitude and a predetermined frequency band to the electrodes 24 and 26 of the electrode unit 22 and thus prevents the freeze of melting frost on the surface of the outdoor heat exchanger 4 with the aid of an electric field generated in the electrode unit 22. In this manner, it is possible to perform a defrost operation and an anti-freeze operation at the same time.

Figure 13:
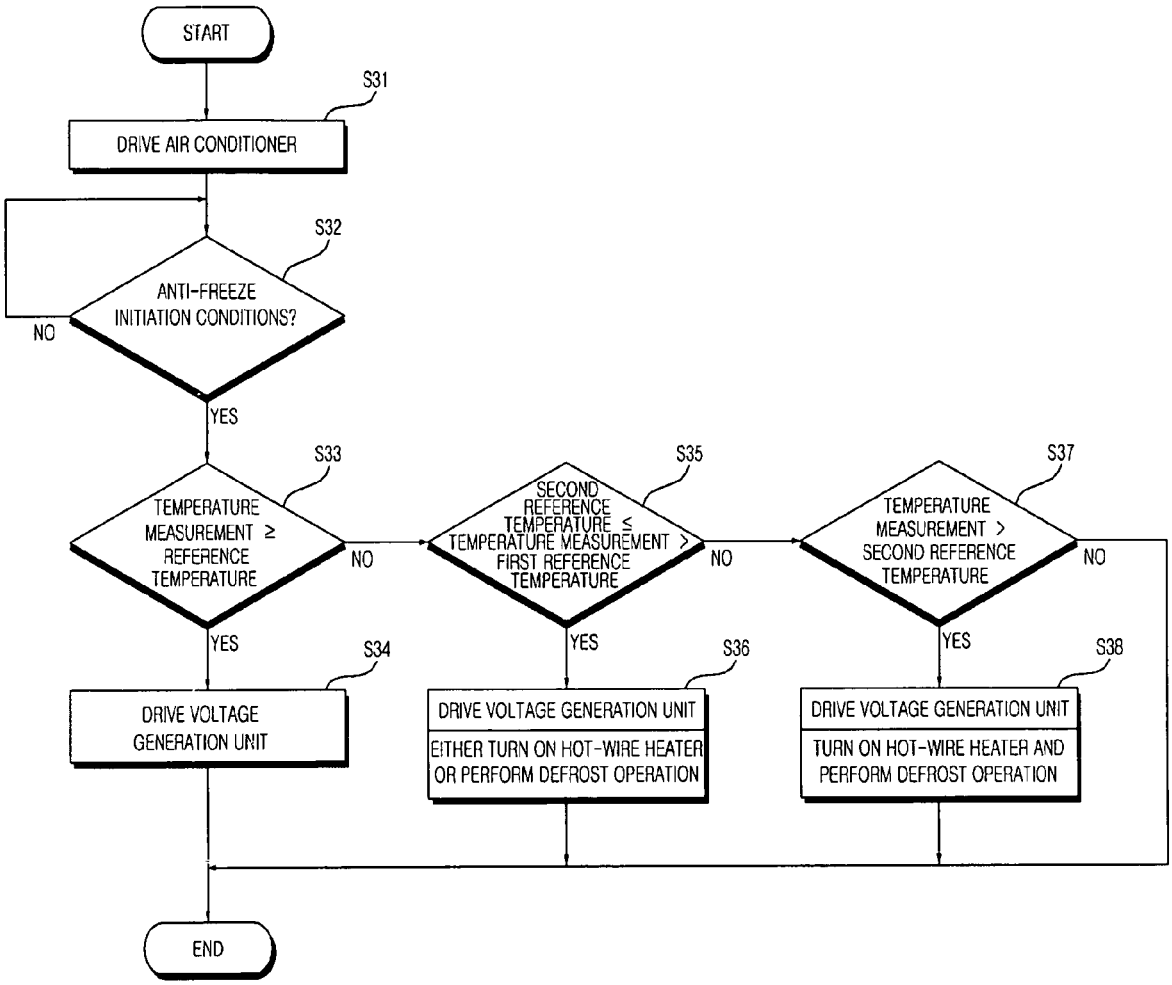
FIG. 13 illustrates a flowchart of a method of controlling an air conditioner according to another embodiment of the present invention.

FIG. 13 illustrates a flowchart of a method of controlling an air conditioner according to another embodiment of the present invention. In the embodiment of FIG. 13, like in the embodiment of FIG. 12, during an operation of an air conditioner, the control unit 32 determines whether the outdoor heat exchanger 4 satisfies a set of anti-freeze initiation conditions (S31 and S32).

If it is determined that the outdoor heat exchanger 4 satisfies the anti-freeze initiation conditions, the control unit 32 may decide whether to perform an anti-freeze operation alone, to perform an anti-freeze operation and one of a heating operation and a defrost operation at the same time, or to perform an anti-freeze operation, a heating operation and a defrost operation at the same time based on a temperature measurement provided by the temperature sensing unit 40.

More specifically, if the temperature of the outdoor heat exchanger 4 or a temperature measurement provided by the temperature sensing unit 40 is higher than a first temperature (e.g., the freezing point of water), the control unit 32 may decide to perform an anti-freeze operation alone, and drive the anti-freeze apparatus 20, and particularly, the voltage generation unit 28 (S33 and S34).

In the embodiment of FIG. 13, like the embodiment of FIG. 12, an electric field is generated between the electrodes 24 and 26 of the electrode unit 22 as a result of the operation of the voltage generation unit 28. The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

On the other hand, if the temperature of the outdoor heat exchanger 4 or the temperature measurement provided by the temperature sensing unit 40 is lower than the first temperature and higher than a second temperature (e.g., a temperature −10° C. lower than the freezing point of water), which is lower than the first temperature, the control unit 32 may decide to drive the anti-freeze apparatus 20 and to either turn on a hot-wire heater or perform a defrost operation (S35 and S36).

If the heat generation unit 30 or a hot-wire heater is turned on or a defrost operation is performed, frost, if any, on the surface of the outdoor heat exchanger 4 may melt due to heat generated by the hot-wire heater or the heat of a coolant. Then, the voltage generation unit 28 applies a voltage having a predefined frequency band and a predefined magnitude to the electrodes 24 and 26 of the electrode unit 22 so that an electric field can be generated between the electrodes 24 and 26. Therefore, it is possible to melt frost on the surface of the outdoor heat exchanger 4 and prevent melting frost from freezing again. That is, it is possible to perform a defrost operation and an anti-freeze operation at the same time.

On the other hand, if the temperature of the outdoor heat exchanger 4 or the temperature measurement provided by the temperature sensing unit 40 is lower than the second temperature, the control unit 32 drives the anti-freeze apparatus 20, turns on a hot-wire heater and performs a defrost operation (S37 and S38). If the hot-wire heater is turned on and a defrost operation is performed, frost, if any, on the surface of the outdoor heat exchanger 4 may melt due to heat generated by the hot-wire heater and the heat of a coolant. Frost on the surface of the outdoor heat exchanger 4 may melt down more quickly in the embodiment of FIG. 13 than in the embodiment of FIG. 12. In the embodiment of FIG. 13, like in the embodiment of FIG. 12, the voltage generation unit 28 applies a voltage having a predefined frequency band and a predefined magnitude to the electrodes 24 and 26 of the electrode unit 22. Then, an electric field is generated between the electrodes 24 and 26 of the electrode unit 22 as a result of the operation of the voltage generation unit 28. The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

Figure 14:
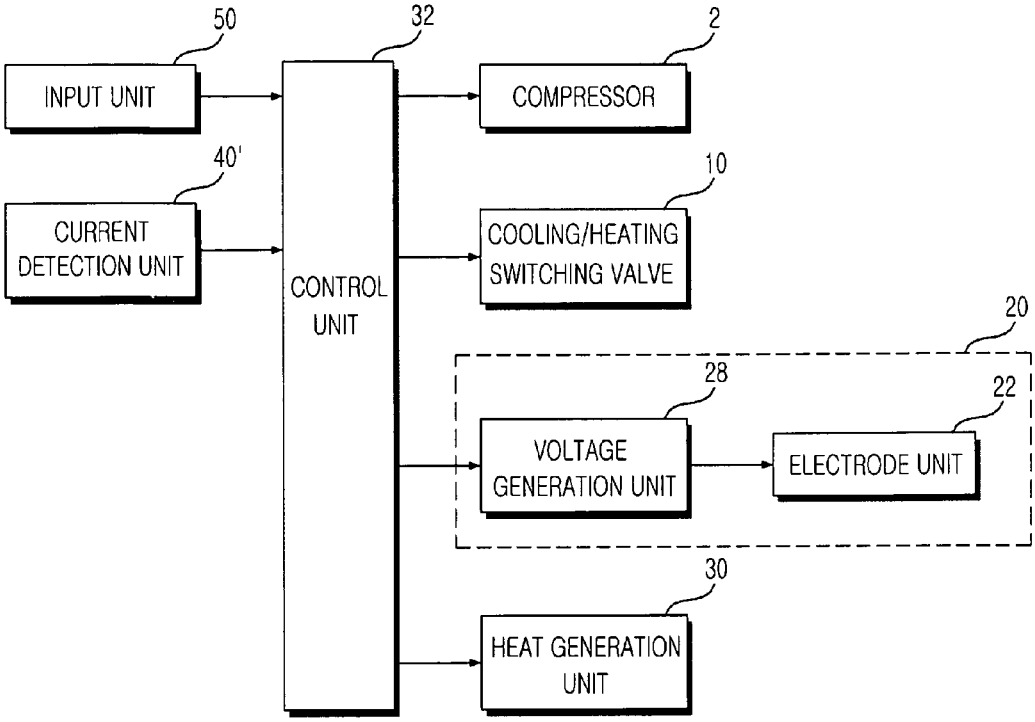
FIG. 14 illustrates a block diagram of an air conditioner according to another embodiment of the present invention.

FIG. 14 illustrates a block diagram of an air conditioner according to another embodiment of the present invention. The air conditioner of the embodiment of FIG. 14 has the same structure as the air conditioner of the embodiment of FIG. 2 except for including a current detection unit 40' or a voltage detection unit (not shown), which detects a current or a voltage resulting from an electric field generated in an outdoor heat exchanger 4 during an operation of an anti-freeze apparatus 20. Thus, the air conditioner of the embodiment of FIG. 14 will hereinafter be described, focusing mainly on the current detection unit 40' or the voltage detection unit.

The resistance of the current detection unit 40' or the voltage detection unit varies according to whether there is water on the surface of the outdoor heat exchanger 4, how much water there is on the surface of the outdoor heat exchanger 4, and whether the water on the surface of the outdoor heat exchanger 4 is frozen. Thus, a control unit 32 may determine whether there is water on the surface of the outdoor heat exchanger 4, whether the water on the surface of the outdoor heat exchanger 4 is frozen and the amount of water on the surface of the outdoor heat exchanger 4 based on a variation in the resistance of the current detection unit 40' or the voltage detection unit, and determines a frequency and magnitude for the voltage generation unit 28 according to the results of the determination. In addition, the control unit 32 may decide whether to drive a heat generation unit 30 and determine a control temperature for the heat generation unit 30. The structure and operation of the current detection unit 40' will hereinafter be described in detail.

Figure 15:
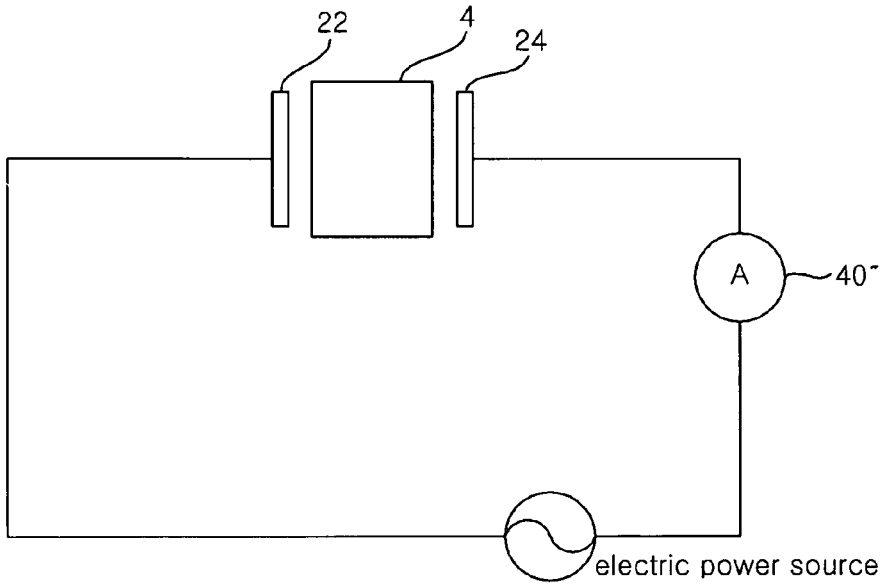
FIG. 15 illustrates a circuit diagram of a current detection structure including a current detection unit illustrated in FIG. 14.
Figure 16:
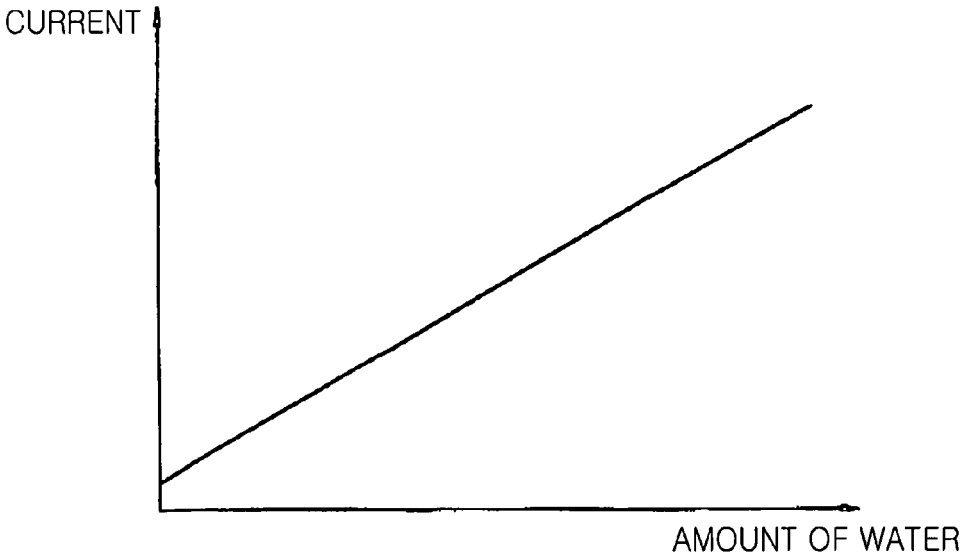
FIG. 16 illustrates a graph of the relationship between a current detected by the current detection unit illustrated in FIG. 14 and the amount of water on the surface of an outdoor heat exchanger.

FIG. 15 illustrates a circuit diagram of a current detection structure including the current detection unit 40' and FIG. 16 illustrates a graph of the relationship between a current detected by the current detection unit 40' and the amount of water on the surface of the outdoor heat exchanger 4.

Referring to FIG. 15, the current detection unit 40' is connected in series to a plurality of electrodes 24 and 26. The current detection unit 40' detects a current applied to the electrodes 24 and 26 and a current flowing into the outdoor heat exchanger 4. Referring to FIG. 16, if the result of the detection performed by the current detection unit 40' is close to 0, it is determined that there is a small amount of water on the surface of the outdoor heat exchanger 4. On the other hand, if the result of the detection performed by the current detection unit 40' is high, it is determined that there is a large amount of water on the surface of the outdoor heat exchanger 4. In this manner, the control unit 32 determines the existence and the amount of water on the surface of the outdoor heat exchanger 4 based on the result of the detection performed by the current detection unit 40'.

That is, the control unit 32 may determine the magnitude and the frequency of a voltage based on the amount of water on the surface of the outdoor heat exchanger 4 according to an equation or table. If there is a small amount of water on the surface of the outdoor heat exchanger 4, the magnitude and the frequency of a voltage generated by the voltage generation unit 28 may be reduced. On the other hand, if there is a large amount of water on the surface of the outdoor heat exchanger 4, the magnitude and the frequency of a voltage generated by the voltage generation unit 28 may be increased.

Figure 17:
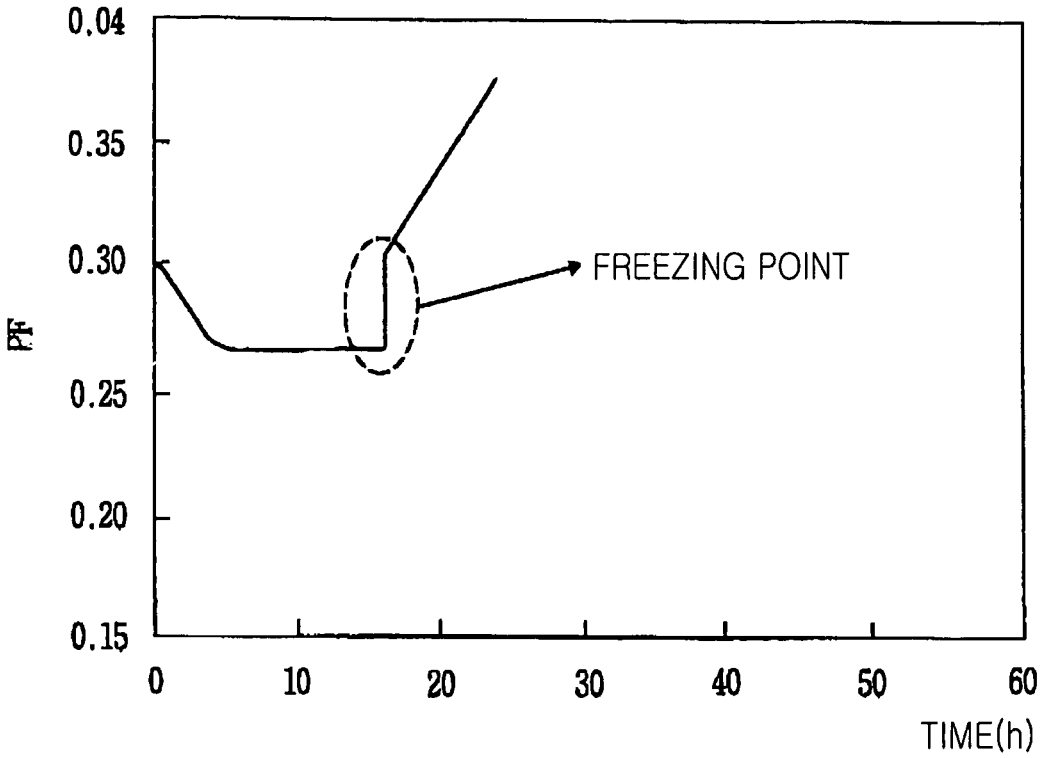
FIG. 17 illustrates a graph of power factor variations detected by the current detection unit illustrated in FIG. 14.
Figure 18:
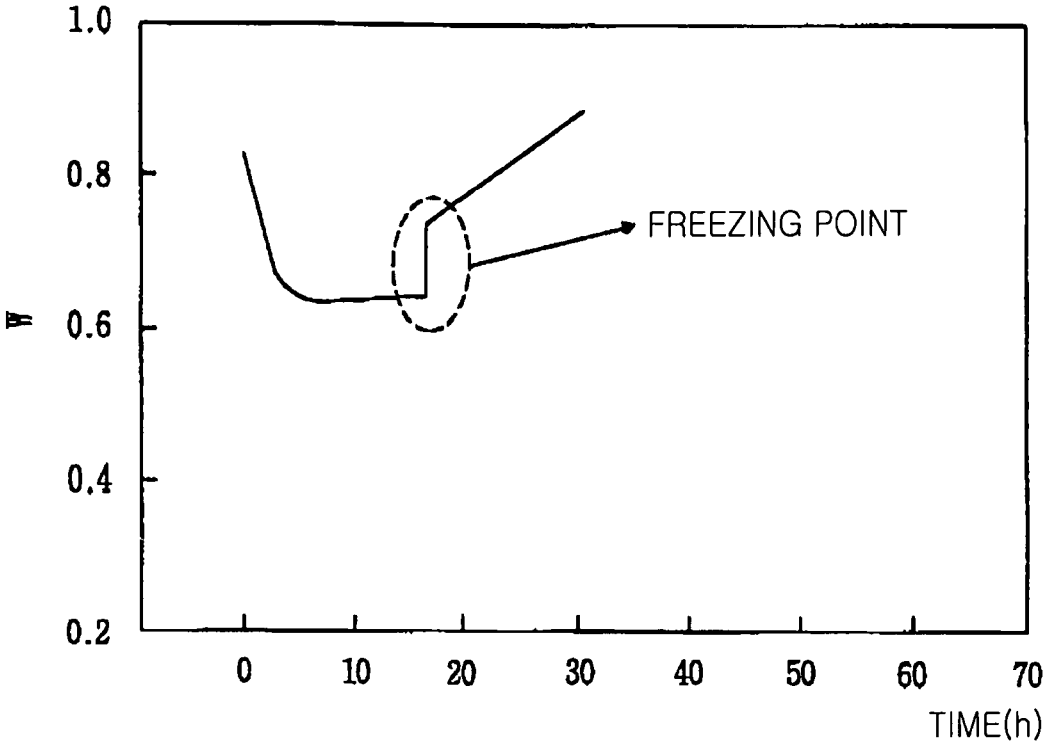
FIG. 18 illustrates a graph of power variations detected by the current detection unit illustrated in FIG. 14.
Figure 19:
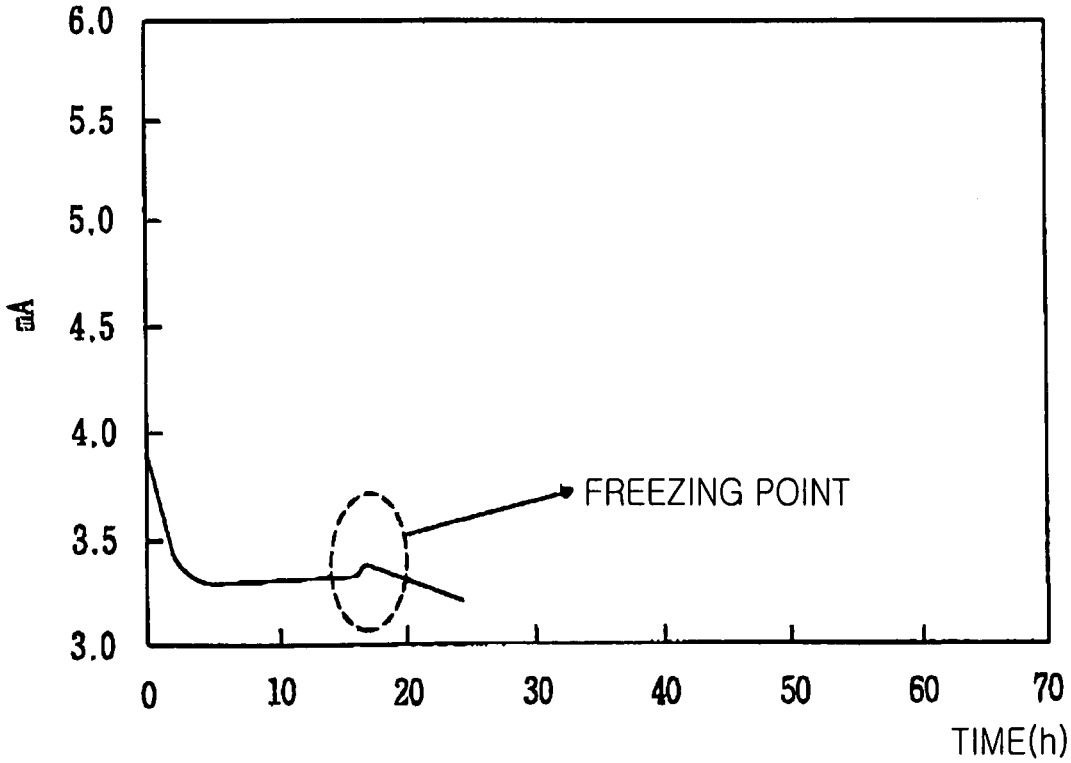
FIG. 19 illustrates a graph of current variations detected by the current detection unit illustrated in FIG. 14.

FIG. 17 illustrates a graph of power factor variations detected by the current detection unit 40' FIG. 18 illustrates a graph of power variations detected by the current detection unit 40' and FIG. 19 illustrates a graph of current variations detected by the current detection unit 40'.

More specifically, FIGS. 17 through 19 illustrate graphs of power factor, power, and current variations when an alternating voltage having a frequency of 20 kHz is applied to a plurality of electrodes. Referring to FIGS. 17 through 19, it appears that the time when a power factor, power and a current drastically change coincides with the time when water on the surface of the outdoor heat exchanger 4 begins to freeze. Therefore, the control unit 32 may determine whether water on the surface of the outdoor heat exchanger 4 is frozen based on the result of detection performed by the current detection unit 40'.

Figure 20:
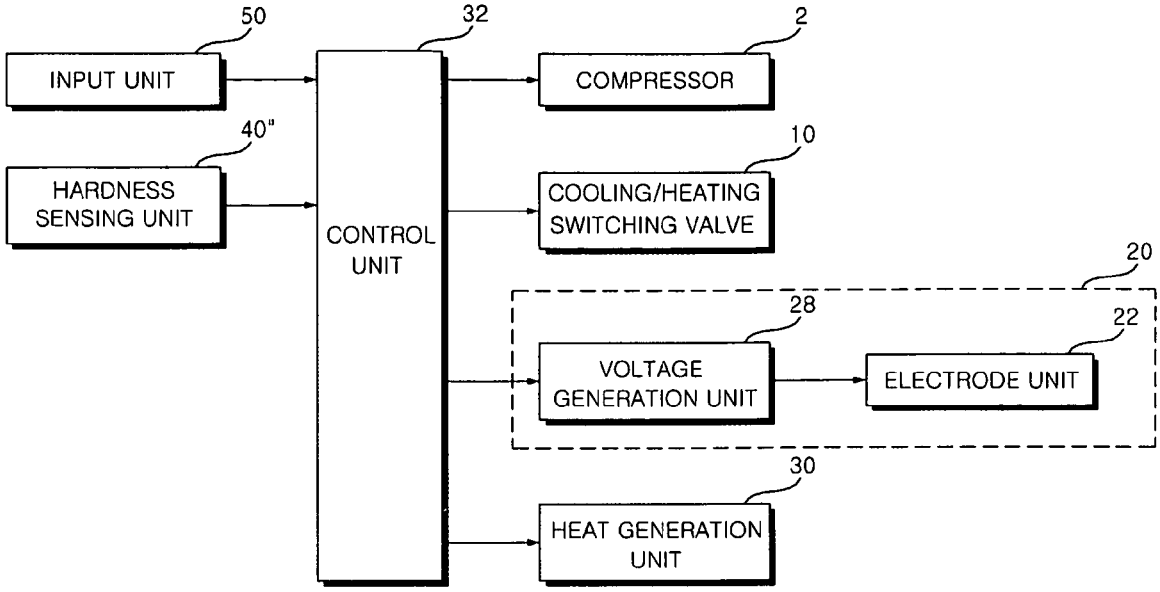
FIG. 20 illustrates a block diagram of an air conditioner according to another embodiment of the present invention.

FIG. 20 illustrates a block diagram of an air conditioner according to another embodiment of the present invention. The air conditioner of the embodiment of FIG. 20 has the same structure as the air conditioner of the embodiment of FIG. 14 except that the air conditioner of the embodiment of FIG. 20 includes a hardness sensing unit 40" which is a type of contact sensor, as a load sensing unit. In FIGS. 14 and 20, like reference numerals represent like elements, and thus, detailed descriptions thereof will be skipped.

Referring to FIG. 20, once water on the surface of an outdoor heat exchanger 4 begins to freeze, the level of hardness sensed by the hardness sensing unit 40" increases considerably. Then, a control unit 32 may determine whether water on the surface of the outdoor heat exchanger 4 is frozen based on the result of the sensing performed by the hardness sensing unit 40".

The present invention is not restricted to the embodiments set forth herein. That is, the present invention may be applied to an integral-type air conditioner in which an indoor unit is formed in one body with an outdoor unit.

While the present invention has been particularly shown and described with reference to exemplary embodiments thereof, it will be understood by those of ordinary skill in the art that various changes in form and details may be made therein without departing from the spirit and scope of the present invention as defined by the following claims.

[Industrial Applicability]

According to the present invention, an anti-freeze apparatus supplies energy to a heat exchanger and can thus prevent the freeze of water on the surface of the heat exchanger during an operation of an air conditioner. Therefore, there is no need to perform a defrost operation during an operation of an air conditioner. The present invention can be applied to air conditioner which can continuously perform an air conditioning function.

The invention claimed is:

1. A method of controlling an air conditioner, the method comprising:

if water on the surface of a heat exchanger is detected to be frozen during an operation of an air conditioner, heating the heat exchanger; and supplying energy to the heat exchanger so that the water on the surface of the heat exchanger can be prevented from freezing, wherein the heating the heat exchanger, comprises:

if the heat exchanger satisfies a set of anti-freeze initiation conditions, performing an anti-freeze operation by supplying energy to the heat exchanger so that water on the surface of the heat exchanger can be prevented from freezing; and if the heat exchanger satisfies a set of anti-freeze release conditions, cutting off the energy supplied to the heat exchanger and heating the heat exchanger.

2. A method of controlling an air conditioner, the method comprising:

if a heat exchanger satisfies a set of anti-freeze initiation conditions during an operation of an air conditioner and the temperature of at least one of a pipe connected to the heat exchanger, the outside of a room in which the air conditioner is installed, and the heat exchanger is higher than a reference temperature, performing an anti-freeze operation alone by supplying energy to the heat exchanger so that water on the surface of the heat exchanger can be prevented from freezing; and if the heat exchanger satisfies the anti-freeze initiation conditions during the operation of the air conditioner and the temperature of at least one of the pipe connected to the heat exchanger, the outside of the room, and the heat exchanger is lower than the reference temperature, performing both an anti-freeze operation and a heating operation by heating the heat exchanger while supplying energy to the heat exchanger.

3. The method of claim 2, wherein the performing both the anti-freeze operation and the heating operation, comprises turning on a hot-wire heater which is disposed near the heat exchanger.

4. The method of claim 2, wherein the performing both the anti-freeze operation and the heating operation, comprises enabling the air conditioner to perform a defrost operation.

5. A method of controlling an air conditioner, the method comprising:

if a heat exchanger satisfies a set of anti-freeze initiation conditions during an operation of an air conditioner and the temperature of at least one of a pipe connected to the heat exchanger, the outside of a room in which the air conditioner is installed, and the heat exchanger is higher than a first reference temperature, performing an anti-freeze operation alone by supplying energy to the heat exchanger so that water on the surface of the heat exchanger can be prevented from freezing;

if the heat exchanger satisfies the anti-freeze initiation conditions during the operation of the air conditioner and the temperature of at least one of the pipe connected to the heat exchanger, the outside of the room, and the heat exchanger is lower than the first reference temperature and higher than a second reference temperature, supplying energy to the heat exchanger and either turning on a heater, which is disposed near the heat exchanger, or performing a defrost operation; and if the heat exchanger satisfies the anti-freeze initiation conditions during the operation of the air conditioner and the temperature of at least one of the pipe connected to the heat exchanger, the outside of the room, and the heat exchanger is lower than the second reference temperature, supplying energy to the heat exchanger, turning on the heater, and performing a defrost operation.

* * * * *